US008134580B2

(12) United States Patent
Kim et al.

(10) Patent No.: US 8,134,580 B2
(45) Date of Patent: Mar. 13, 2012

(54) LIQUID CRYSTAL DISPLAY AND DRIVING METHOD THEREOF

(75) Inventors: Chang Gone Kim, Deagu (KR); Sung Jo Koo, Daegu (KR); Myung Kook Moon, Daegu (KR); Jin Ha Lee, Daegu (KR)

(73) Assignee: LG Display Co., Ltd., Seoul (KR)

( * ) Notice: Subject to any disclaimer, the term of this patent is extended or adjusted under 35 U.S.C. 154(b) by 194 days.

(21) Appl. No.: 12/716,790

(22) Filed: Mar. 3, 2010

(65) Prior Publication Data

US 2010/0156961 A1 Jun. 24, 2010

Related U.S. Application Data

(62) Division of application No. 11/646,554, filed on Dec. 28, 2006, now Pat. No. 7,701,429.

(30) Foreign Application Priority Data

Jun. 27, 2006 (KR) ..... 10-2006-0058069
Jun. 27, 2006 (KR) ..... 10-2006-0058083

(51) Int. Cl.
*G09G 5/10* (2006.01)

(52) U.S. Cl. ..... 345/690; 345/4; 345/76; 345/87; 345/89; 345/94; 345/98; 345/99; 345/100; 345/204; 345/208

(58) Field of Classification Search ..... 345/4, 76, 345/87, 89, 94, 98–100, 204, 208
See application file for complete search history.

(56) References Cited

U.S. PATENT DOCUMENTS

| | | | | |
|---|---|---|---|---|
| 4,496,972 | A | 1/1985 | Lippmann et al. | |
| 6,184,874 | B1 * | 2/2001 | Smith et al. | 345/204 |
| 7,009,627 | B2 * | 3/2006 | Abe et al. | 345/690 |
| 7,333,673 | B2 | 2/2008 | Wang | |
| 2004/0263495 | A1 | 12/2004 | Sugino et al. | |
| 2005/0140626 | A1 | 6/2005 | Doyen et al. | |
| 2006/0125810 | A1 * | 6/2006 | Lee | 345/204 |

OTHER PUBLICATIONS

MotionPerfect™ 4.3, Fact Sheet, DynaPel, Nov. 2003, 4 Seiten; (4 pages).

* cited by examiner

*Primary Examiner* — Richard Hjerpe
*Assistant Examiner* — Jeffrey Steinberg
(74) *Attorney, Agent, or Firm* — McKenna Long & Aldridge, LLP

(57) ABSTRACT

A method of driving a liquid crystal display device includes multiplying a frame frequency of an inputted current frame to generate a multiplied odd-numbered frame and a multiplied even-numbered frame; determining whether said current frame is a still image frame or a dynamic image frame; detecting an edge area at which a motion blur occurs from the multiplied odd-numbered frame and the multiplied even-numbered frame; converting gray level values of pixels positioned at the detected edge area at the multiplied odd-numbered frame and the multiplied even-numbered frame; and continuously outputting the multiplied odd-numbered still image frame and the multiplied even-numbered still image frame or continuously outputting the multiplied odd-numbered dynamic image frame and the multiplied even-numbered dynamic image frame having the converted gray level values in accordance with the determined result. A liquid crystal display device is also disclosed.

29 Claims, 31 Drawing Sheets

FIG.19

| | | | | | |
|---|---|---|---|---|---|
| PX1 | PX2 | PX3 | PX4 | PX5 | PX6 |
| PX7 | PX8 | PX9 | PX10 | PX11 | PX12 |
| PX13 | PX14 | PX15 | PX16 | PX17 | PX18 |
| PX19 | PX20 | PX21 | PX22 | PX23 | PX24 |
| PX25 | PX26 | PX27 | PX28 | PX29 | PX30 |
| PX31 | PX32 | PX33 | PX34 | PX35 | PX36 |
| PX37 | PX38 | PX39 | PX40 | PX41 | PX42 |

LIQUID CRYSTAL DISPLAY AND DRIVING METHOD THEREOF

CROSS-REFERENCE TO RELATED APPLICATIONS

This application is a Divisional of application Ser. No. 11/646,554 filed Dec. 28, 2006, now U.S. Pat. No. 7,701,429; which claims priority to Korean Patent Application No. 10-2006-0058069 and 10-2006-058083, filed Jun. 27, 2006 all of which are hereby incorporated by reference for all purposes as if fully set forth herein.

BACKGROUND OF THE INVENTION

1. Field of the Invention

This invention relates to a liquid crystal display, and more particularly to a liquid crystal display and a driving method thereof wherein a frame can be driven by multiplying a frame frequency while keeping the brightness identical to brightness for the non-multiplied frame driving.

2. Description of the Related Art

Generally, a liquid crystal display (LCD) controls light transmittance of liquid crystal cells in accordance with video signals to thereby display a picture. An active matrix type of liquid crystal display device having a switching device provided for each liquid crystal cell is advantageous for displaying a moving picture because it permits an active control of the switching device. The switching device used for the active matrix liquid crystal display device is generally a thin film transistor (TFT) as illustrated in FIG. 1.

Referring to FIG. 1, the active matrix LCD converts a digital input data into an analog data voltage on the basis of a gamma reference voltage to supply it to a data line DL and, at the same time, supplies a scanning pulse to a gate line GL to thereby charge a liquid crystal cell Clc.

A gate electrode of the TFT is connected to the gate line GL while a source electrode of the TFT thereof is connected to the data line DL. Further, a drain electrode of the TFT is connected to a pixel electrode of the liquid crystal cell Clc and to one electrode of a storage capacitor Cst.

A common electrode of the liquid crystal cell Clc is supplied with a common voltage Vcom.

The storage capacitor Cst functions to charge a data voltage fed from the data line DL when the TFT is turned on, thereby constantly maintaining a voltage at the liquid crystal cell Clc.

If the scanning pulse is applied to the gate line GL, then the TFT is turned on to provide a channel between the source electrode and the drain electrode, thereby supplying a voltage on the data line DL to the pixel electrode of the liquid crystal cell Clc. At this time, liquid crystal molecules of the liquid crystal cell has an alignment changed by an electric field between the pixel electrode and the common electrode to thereby modulate an incident light.

A configuration of the related art LCD including pixels having the above-mentioned structure will be described with reference to FIG. 2.

FIG. 2 is a block diagram illustrating a configuration of a general liquid crystal display device.

Referring to FIG. 2, a general liquid crystal display device 100 includes a liquid crystal display panel 110 provided with a plurality of thin film transistors (TFT) at crossing points of data lines DL1 to DLm and gate lines GL1 to GLn for driving the liquid crystal cells Clc, a data driver 120 for supplying a data to the data lines DL1 to DLm of the liquid crystal display panel 110, a gate driver 130 for supplying a scanning pulse to the gate lines GL1 to GLn of the liquid crystal display panel 110, a gamma reference voltage generator 140 for generating a gamma reference voltage to supply it to the data driver 120, a backlight assembly 150 for irradiating a light onto the liquid crystal display panel 110, an inverter 160 for applying an alternating current voltage and a current to the backlight assembly 160, a common voltage generator 170 for generating a common voltage Vcom to supply to the common electrode of the liquid crystal cell Clc of the liquid crystal display panel 110, a gate driving voltage generator 180 for generating a gate high voltage VGH and a gate low voltage VGL to supply them to the gate driver 130, and a timing controller 190 for controlling the data driver 120 and the gate driver 130.

The liquid crystal display panel 110 has a liquid crystal between two glass substrates. On the lower glass substrate of the liquid crystal display panel 110, the data lines DL1 to DLm and the gate lines GL1 to GLn perpendicularly cross each other. Each crossing of the data lines DL1 to DLm and the gate lines GL1 to GLn is provided with the TFT. The TFT supplies a data on the data lines DL1 to DLm to the liquid crystal cell Clc in response to the scanning pulse. The gate electrode of the TFT is connected to the gate lines GL1 to GLn, while the source electrode thereof is connected to the data line DL1 to DLm. Further, the drain electrode of the TFT is connected to the pixel electrode of the liquid crystal cell Clc and to the storage capacitor Cst.

The TFT is turned on in response to the scanning pulse applied, via the gate lines GL1 to GLn, to the gate terminal thereof. Upon turning-on of the TFT, video data on the data lines DL1 to DLm is supplied to the pixel electrode of the liquid crystal cell Clc.

The data driver 120 supplies data to the data lines DL1 to DLm in response to a data driving control signal DDC from the timing controller 190. Further, the data driver 120 samples and latches a digital video data RGB fed from the timing controller 190, and then converts it into an analog data voltage capable of expressing a gray scale level at the liquid crystal cell Clc of the liquid crystal display panel 110 on a basis of a gamma reference voltage from the gamma reference voltage generator 140, thereby supplying it the data lines DL1 to DLm.

The gate driver 130 sequentially generates a scanning pulse, that is, a gate pulse, in response to a gate driving control signal GDC and a gate shift clock GSC from the timing controller 190 to supply them to the gate lines GL1 to GLn. At this time, the gate driver 130 determines a high level voltage and a low level voltage of the scanning pulse in accordance with the gate high voltage VGH and the gate low voltage VGL from the gate driving voltage generator 180.

The gamma reference voltage generator 140 receives a high-level supply voltage VDD to generate a positive gamma reference voltage and a negative gamma reference voltage and output them to the data driver 120.

The backlight assembly 150 is provided at the rear side of the liquid crystal display panel 110, and is energized by an alternating current voltage and a current supplied to the inverter 160 to irradiate light onto each pixel of the liquid crystal display panel 110.

The inverter 160 converts a rectangular wave into a triangular wave signal and then compares the triangular wave signal with a direct current power voltage Vcc supplied from said system, thereby generating a burst dimming signal proportional to a result of the comparison. If the burst dimming signal determines in accordance with the rectangular wave signal at the interior of the inverter 160, then a driving integrated circuit (IC), as not illustrated, for controlling a generation of the AC voltage and current within the inverter 160 controls a generation of AC voltage and current supplied to the backlight assembly 150 in response to the burst dimming signal.

The common voltage generator 170 receives a high-level power voltage VDD to generate a common voltage Vcom and supplies it to the common electrode of the liquid crystal cell Clc provided at each pixel of the liquid crystal display panel 110.

The gate driving voltage generator 180 is supplied with a high-level power voltage VDD to generate the gate high voltage VGH and the gate low voltage VGL, and supplies them to the data driver 130. Herein, the gate driving voltage generator 180 generates a gate high voltage VGH more than a threshold voltage of the TFT provided at each pixel of the liquid crystal display panel 110 and a gate low voltage VGL less then the threshold voltage of the TFT. The gate high voltage VGH and the gate low voltage VGL generated in this manner are used for determining a high level voltage and a low level voltage of the scanning pulse generated by the gate driver 130, respectively.

The timing controller 190 supplies a digital video data RGB from a digital video card (not shown) to the data driver 120 and, at the same time, generates a data driving control signal DCC and a gate driving control signal GDC using horizontal/vertical synchronizing signals H and V in response to a clock signal CLK to supply them to the data driver 120 and the gate driver 130, respectively. The data driving control signal DDC includes a source shift clock SSC, a source start pulse SSP, a polarity control signal POL and a source output enable signal SOE, etc. The gate driving control signal GDC includes a gate start pulse GSP and a gate output enable signal GOE, etc.

The liquid crystal display device 100 having the above-mentioned configuration and function is typically driven with a frequency of 60 Hz. However, there have been recently developed a technique of driving the liquid crystal display device 100 with a frequency of 120 Hz in order to eliminate a stain at the moving picture.

When the liquid crystal display device 100 is driven with 120 Hz, a gray data conversion is carried out, while allowing an average brightness of two frames to equally keep a brightness of one frame when the liquid crystal display device 100 is driven with 60 Hz. In this case, there is raised a disadvantage in that, because a high gray and a low gray is alternately displayed on the screen, a flicker can be viewed by human eyes.

SUMMARY OF THE INVENTION

Accordingly the present invention is directed to a liquid crystal display and driving method thereof that substantially obviates one or more of the limitations or problems of the related art.

Accordingly, it is an advantage of the present invention to provide a liquid crystal display and a driving method thereof wherein a frame can be driven by multiplying a frame frequency while keeping the brightness substantially the same as brightness for the non-multiplied frame driving.

Another advantage of the present invention is to provide a liquid crystal display and a driving method thereof that are capable of continuously driving the same still image frames within a certain time without converting gray level values of the still image frames during the multiplication of frame frequency.

Yet another advantage of the present invention is to provide a liquid crystal display and a driving method thereof that are capable of continuously driving the same still image frames within a certain time without converting gray level values of the still image frames during the multiplication of frame frequency, whereby minimizing a flicker occurring at the still image frame due to the multiplication of frame frequency.

Yet another advantage of the present invention is to provide a liquid crystal display and a driving method thereof that are capable of converting only a gray level value of a pixel positioned at an edge area where a motion blur is generated during the multiplication of frame frequency.

Yet another advantage of the present invention is to provide a liquid crystal display and a driving method thereof that are capable of converting only a gray level value of a pixel positioned at an edge area where a motion blur is generated during the multiplication of frame frequency, whereby reducing a brightness difference at the entire field caused by a gray level data insertion.

Yet another advantage of the present invention is to provide a liquid crystal display and a driving method thereof that are capable of reducing a brightness difference at the entire field caused by the frame frequency multiplication and the gray level data insertion, thereby reducing a motion blur caused by the brightness difference and a flicker.

In order to achieve these and other advantages of the invention, a liquid crystal display device includes frame processing means for multiplying a frame frequency of an inputted current frame to generate a multiplied odd-numbered frame and a multiplied even-numbered frame, and for outputting a multiplied odd-numbered still image frame and a multiplied even-numbered still image frame without any conversion of gray level values when the current frame is a still image frame while outputting a multiplied odd-numbered dynamic image frame and a multiplied even-numbered dynamic image frame with converted gray level values when the current frame is a dynamic image frame; timing controlling means for controlling a driving timing of the odd-numbered still image frame and the even-numbered still image frame multiplied by said frame processing means or controlling a driving timing of the odd-numbered dynamic image frame and the even-numbered dynamic image frame having gray level values multiplied and converted by said frame processing means; and data driving means for substantially continuously driving the odd-numbered still image frame and the even-numbered still image frame multiplied by said frame processing means within a certain time with respect to a liquid crystal display panel or substantially continuously driving the odd-numbered dynamic image frame and the even-numbered dynamic image frame having gray level values multiplied and converted by said frame processing means within a certain time with respect to the liquid crystal display panel under control of said timing control means.

In another aspect of the present invention, a liquid crystal display device includes frequency converting means for multiplying a frame frequency of an inputted current frame to continuously output a multiplied odd-numbered frame and a multiplied even-numbered frame; frame discriminating means for determining whether the current frame is a still image frame or a dynamic image frame to generate a first selection signal or a second selection signal in accordance with the determined result; gray level converting means for converting gray level values of pixels at the multiplied odd-numbered frame and the multiplied even-numbered frame; and selecting means for substantially continuously outputting the multiplied odd-numbered still image frame and the multiplied even-numbered still image frame in response to said first selection signal or substantially continuously outputting the odd-numbered dynamic image frame and the multiplied even-numbered dynamic image frame having gray levels converted by the gray level converting means in response to said second selection signal.

In another aspect of the present invention, a method of driving a liquid crystal display device includes the steps of (A) if a current frame is inputted in such a state that a previous frame has been stored, multiplying a first frame frequency into a second frame frequency to generate the same still image frames or the same dynamic image frames driven substantially continuously within a certain time; (B) converting gray level values of pixels at the generated frames to be driven with said second frame frequency; (C) determining whether the current frame is a still image frame or a dynamic image frame with the aid of said previous frame to generate a first selection signal or a second selection signal in accordance with the determined result; and (D) substantially continuously outputting the generated still image frames in response to said first selection signal and substantially continuously outputting the dynamic image frames having the converted gray levels in response to said second selection signal.

In another aspect of the present invention, a liquid crystal display device, includes frequency converting means for multiplying a frame frequency of an inputted current frame to continuously outputting a multiplied odd-numbered frame and a multiplied even-numbered frame within a certain time; edge detecting means for detecting an edge area at which a motion blur occurs from the multiplied odd-numbered frame and the multiplied even-numbered frame; and gray level converting means for converting gray levels of pixels positioned at the detected edge area of pixels at said multiplied odd-numbered frame into high gray levels and, at the same time, converting gray levels of pixels positioned at the detected edge area of pixels at said multiplied even-numbered frame into low gray levels.

In another aspect of the present invention, a method of driving a liquid crystal display device, includes the steps of (A) multiplying a first frame frequency of an inputted current frame into a second frame frequency to generate a multiplied odd-numbered frame and a multiplied even-numbered frame; (B) detecting an edge area at which a motion blur occurs from the multiplied odd-numbered frame and the multiplied even-numbered frame; and (C) converting gray levels of pixels positioned at the detected edge area of pixels at said multiplied odd-numbered frame into high gray levels and converting gray levels of pixels positioned at the detected edge area of pixels at said multiplied even-numbered frame, into low gray levels.

In another aspect of the present invention, a liquid crystal display device, includes a frame processor for multiplying a frame frequency of an inputted current frame to generate a multiplied odd-numbered frame and a multiplied even-numbered frame, and for outputting a multiplied odd-numbered still image frame and a multiplied even-numbered still image frame without conversion of gray level values when the current frame is a still image frame while outputting pixels positioned at an edge area at a multiplied odd-numbered dynamic image frame and a multiplied even-numbered dynamic image frame with conversion of gray level values when the current frame is a dynamic image frame; a timing controller for controlling a driving timing of the odd-numbered frame and the even-numbered frame multiplied by said frame processor; and a data driver for continuously driving the odd-numbered frame and the even-numbered frame multiplied by said frame processor within a certain time with respect to a liquid crystal display panel under control of said timing controller.

In another aspect of the present invention, a driving apparatus for a liquid crystal display device includes a frame processor for multiplying a frame frequency of an inputted current frame to continuously output a multiplied odd-numbered frame and a multiplied even-numbered frame within a certain time; a frame discriminator for determining whether said current frame is a still image frame or a dynamic image frame; an edge detector for detecting an edge area at which a motion blur occurs from the multiplied odd-numbered frame and the multiplied even-numbered frame; a gray level converter for converting gray level values of pixels positioned at the detected edge area at the multiplied odd-numbered frame and the multiplied even-numbered frame; and a multiplexer for continuously outputting the odd-numbered still image frame and the even-numbered still image frame multiplied by the frequency converter and continuously outputting the multiplied odd-numbered dynamic image frame and the multiplied even-numbered dynamic image frame having gray level values converted by the gray level converter in accordance with the determined result of the frame discriminator.

In another aspect of the present invention, a method of driving a liquid crystal display device includes the steps of: (A) multiplying a frame frequency of an inputted current frame to generate a multiplied odd-numbered frame and a multiplied even-numbered frame; (B) determining whether said current frame is a still image frame or a dynamic image frame; (C) detecting an edge area at which a motion blur occurs from the multiplied odd-numbered frame and the multiplied even-numbered frame; (D) converting gray level values of pixels positioned at the detected edge area at the multiplied odd-numbered frame and the multiplied even-numbered frame; and (E) continuously outputting the multiplied odd-numbered still image frame and the multiplied even-numbered still image frame or continuously outputting the multiplied odd-numbered dynamic image frame and the multiplied even-numbered dynamic image frame having the converted gray level values in accordance with the determined result.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 19 illustrates an alignment of the pixels in the liquid crystal display device according to another embodiment of the present invention;

DETAILED DESCRIPTION OF THE ILLUSTRATED EMBODIMENT

Reference will now be made in detail to an embodiment of the present invention, example of which is illustrated in the accompanying drawings.

Figure 3:
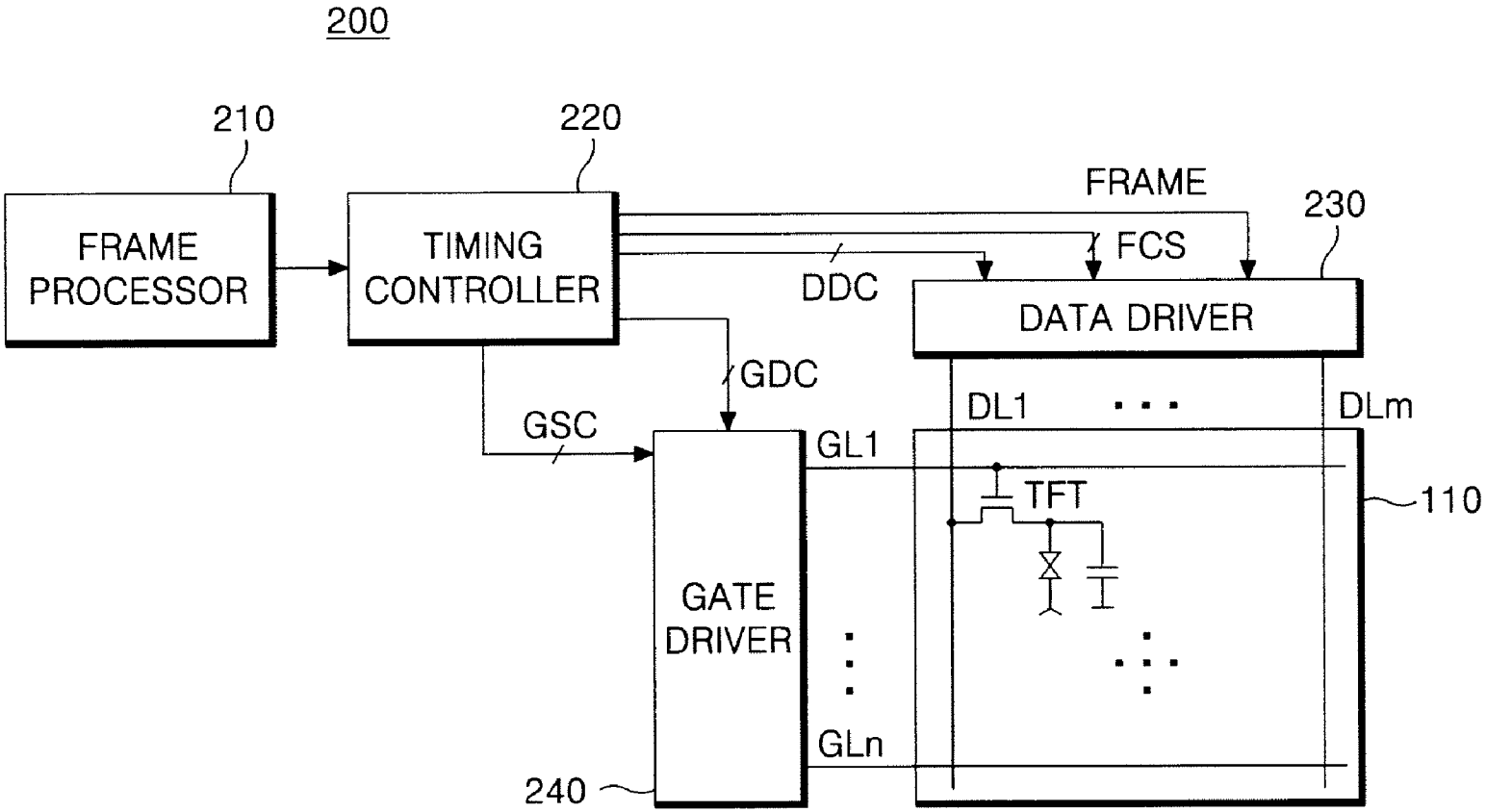
FIG. 3 is a block diagram illustrating a configuration of a liquid crystal display device according to an embodiment of the present invention.

FIG. 3 shows a configuration of a liquid crystal display device according to an embodiment of the present invention.

Figure 1:
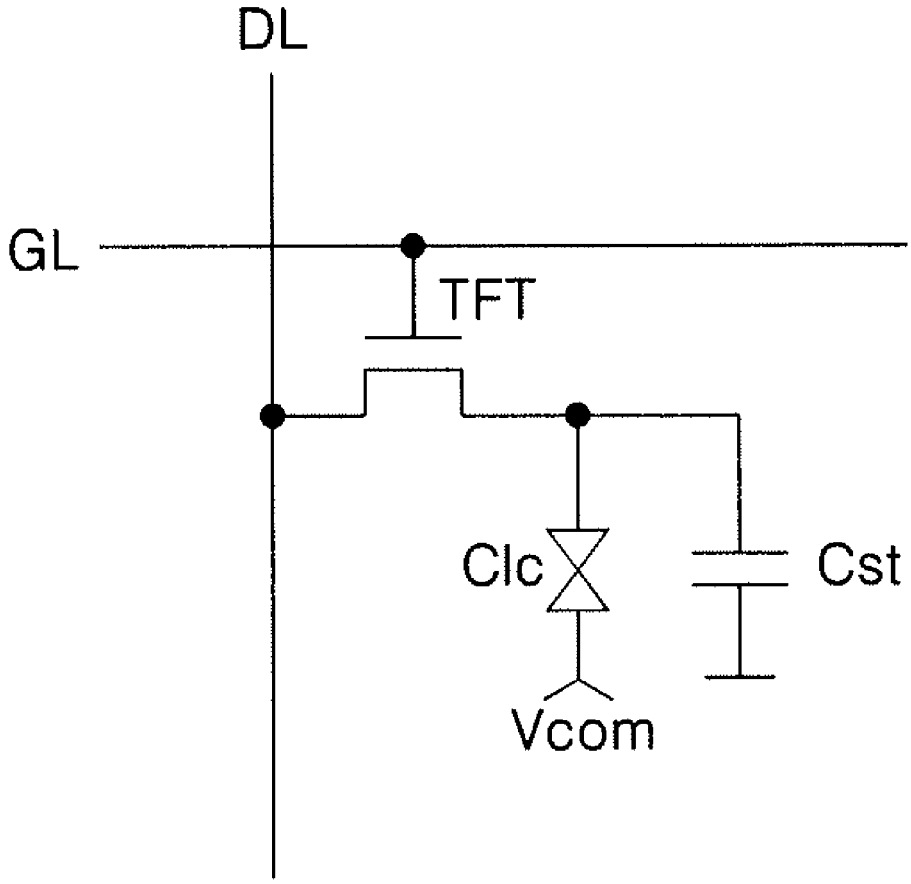
FIG. 1 RELATED ART
FIG. 1 is an equivalent circuit diagram of a pixel provided at a general liquid crystal display device.
Figure 2:
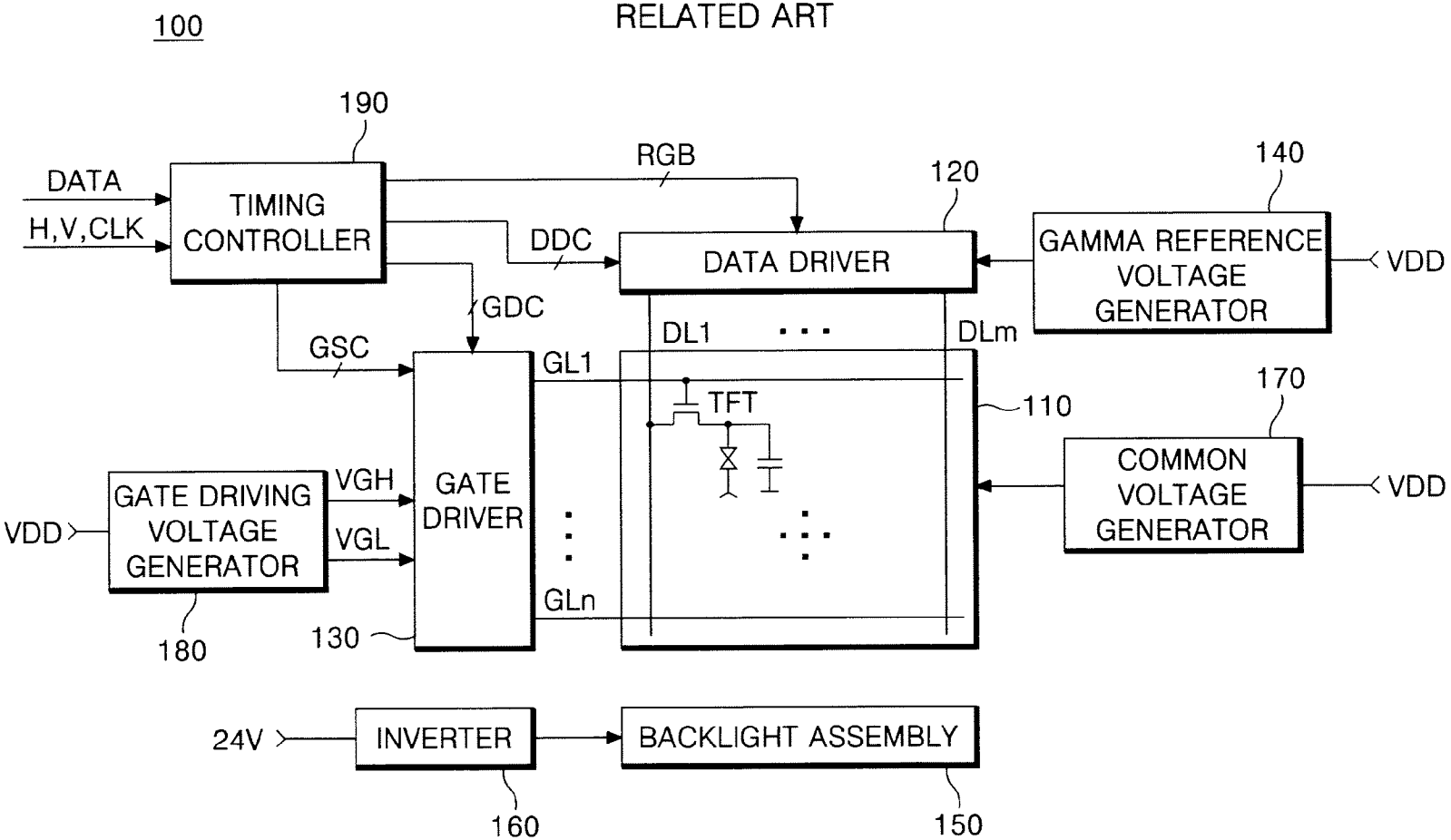
FIG.2 RELATED ART
FIG. 2 is a block diagram illustrating a configuration of a related art liquid crystal display device.

For the sake of understanding, it is assumed that the liquid crystal display device 200 of FIG. 3 includes a gamma reference voltage generator 140, a backlight assembly 150, an inverter 160, a common voltage generator 170 and a gate driving voltage generator 180 similar to the liquid crystal display device 100 as illustrated in FIG. 2. However, these elements are not illustrated in the figure for the sake of explanation convenience.

Referring to FIG. 3, the liquid crystal display device 200 includes a frame processor 210 for multiplying a frame frequency of an inputted current frame to generate a multiplied odd-numbered frame and a multiplied even-numbered frame; for outputting a multiplied odd-numbered still image frame and a multiplied even-numbered still image frame with no conversion of a gray level value when the current frame is a still image frame; and for converting gray level values of pixels at a multiplied odd-numbered dynamic image frame and a multiplied even-numbered dynamic image frame to output them, a timing controller 220 for controlling a driving timing of the odd-numbered frame and the even-numbered frame multiplied by the frame processor 210, a data driver 230 for continuously driving the odd-numbered frame and the even-numbered frame multiplied by the frame processor 210 within a certain time in response to a frame driving control signal from the timing controller 220, and a gate driver 240 for sequentially generating a scanning pulse in response to a gate driving control signal from the timing controller 220 to apply them to gate lines GL1 to GLn.

The frame processor 210 multiplies a frame frequency of the current frame inputted from a system to generate the same frames continuously driven within a certain time, and determines whether the current frame is a still image frame or a dynamic image frame to selectively generate a first selection signal or a second selection signal in accordance with the determined result. Herein, the frame processor 210 generates the first selection signal for indicating an output of the still image frame when the current frame is a still image frame while generating the second selection signal for indicating an output of the dynamic image frame when the current frame is a dynamic image frame.

Further, the frame processor 210 converts gray level values of pixels at the multiplied odd-numbered frame and the multiplied even-numbered frame. After the gray level values are converted, the frame processor 210 continuously outputs the multiplied odd-numbered still image frame and the multiplied even-numbered still image frame to the timing controller 220 in response to the first selection signal, or continuously outputs the odd-numbered dynamic image frame and the even-numbered dynamic image frame having the multiplied and converted gray level values to the timing controller 220 in response to the second selection signal.

When the current frame is a still image frame, the timing controller 220 continuously outputs the odd-numbered still image frame and the even-numbered still image frame multiplied by the frame processor 210 to the data driver 220 within a certain time and, at the same time, applies a frame driving control signal FCS to the data driver 220 to control a frame driving timing of the data driver 220. On the other hand, when the current frame is a dynamic image frame, the timing controller 220 continuously outputs the odd-numbered still image frame and the even-numbered still image frame having gray level values multiplied and converted by the frame processor 210 within a certain time and, at the same time, applies the frame driving signal FCS to the data driver 230 to control a frame driving timing of the data driver 230.

Further, the timing controller 220 generates a data driving control signal DDC and a gate driving control signal GDC with the aid of horizontal/vertical synchronizing signals H and V (not shown) from the system in response to a clock signal CLK (not shown) from the system to apply them to the data driver 230 and the gate driver 240, respectively. Herein, the data driving control signal DDC includes a source shift clock SSC, a source start pulse SSP, a polarity control signal POL and a source output enable signal SOE, etc. The gate driving control signal GDC includes a gate start pulse GSP and a gate output enable signal GOE, etc.

The data driver 230 continuously drives the odd-numbered dynamic image frame and the even-numbered dynamic image frame having gray level values multiplied and converted by the frame processor 210 within a certain time, or continuously drives the odd-numbered still image frame and the even-numbered still image frame multiplied by the frame processor 210 within a certain time in response to the frame driving control signal FCS from the timing controller 220.

The gate driver 240 sequentially generates a scanning pulse in response to the gate driving control signal GDC and the gate shift clock GSC from the timing controller 220 to apply them to the gate lines GL1 to GLn. The gate driver 240 sequentially applies the scanning pulse to the gate lines GL1 to GLn when the odd-numbered frame, of the odd-numbered frame and the even-numbered frame having frame frequencies multiplied by the frame processor 210, is being driven, and thereafter sequentially applies the scanning pulse to the gate lines GL1 to GLn again when the even-numbered frame is being driven.

Figure 4:
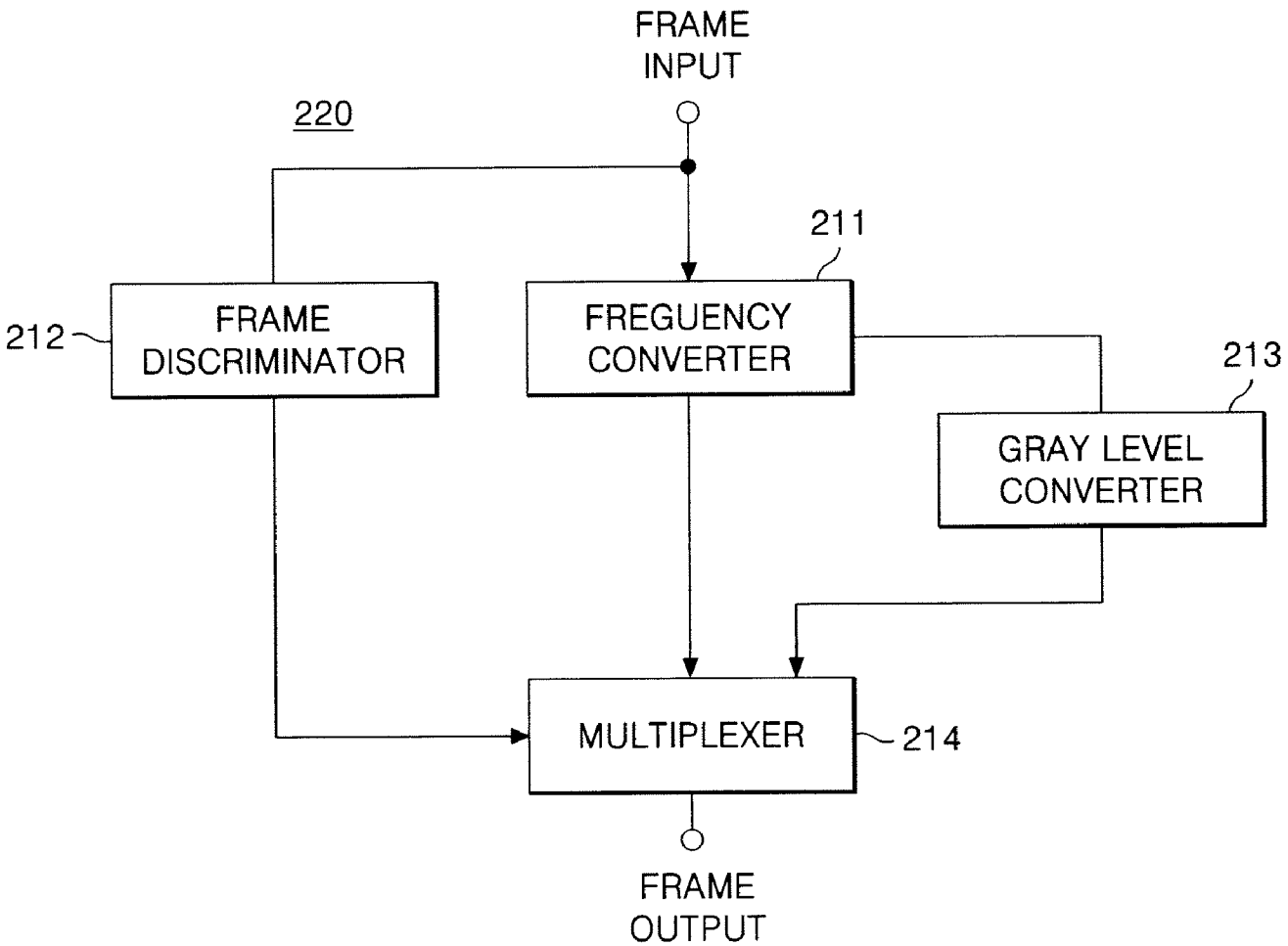
FIG. 4 is a block diagram of the frame processor illustrated in FIG. 3.

FIG. 4 illustrates a configuration of the frame process 210 in FIG. 3.

Referring to FIG. 4, the frame processor 210 includes a frequency converter 211 for multiplying a frame frequency of the inputted current frame to substantially continuously output the multiplied odd-numbered frame and the multiplied even-numbered frame within a certain time, a frame discriminator 212 for determining whether the current frame is a still image frame or a dynamic image frame to selectively generate first and second selection signals in accordance with the determined result, a gray level converter 213 for converting gray level values of pixels at the odd-numbered frame and the even-numbered frame from the frequency converter 211, and a multiplexer 214 for substantially continuously outputting the odd-numbered still image frame and the even-numbered still image frame multiplied by the frequency converter 211 in response to the first selection signal or continuously outputting the odd-numbered dynamic image frame and the even-numbered dynamic image frame having gray level values converted by the gray level converter 230 in response to the second selection signal.

The frequency converter 211 temporarily stores the inputted current frame, and thereafter multiplies the first frame frequency into the second frame frequency to substantially continuously read out the stored frame within a certain time, thereby outputting them to the gray level converter 230 and the input terminal of the multiplexer 240. The frequency converter 211 multiplies a frame frequency by a dynamic data insertion (DDI) system. For example, the frequency converter 211 temporarily stores the inputted current frame data, and reads out the current frame data within a certain time to continuously output the same frame.

One embodiment of the present liquid crystal display device has been implemented such that the frequency converter 211 converts a first frame frequency of 60 Hz into a second frame frequency of 120 Hz when the current frame is inputted via the frame input terminal thereof, but is not limited to this implementation. For instance, the liquid crystal display device may be implemented such that the frequency converter 211 converts a first frame frequency of 50 Hz into a second frame frequency of 60 Hz.

The frame discriminator 212 stores a previous frame of the inputted current frame, and thereafter reads out the previous frame in response to an input of the current frame to calculate gray level difference values between the corresponding pixels at the previous frame and the current frame. Subsequently, the frame discriminator 212 adds the calculated gray level values to each other, and thereafter compares the added value with a predetermined reference gray level value to generate the first selection signal or the second selection signal in accordance with the compared result and output it to the multiplexer 214.

The gray level converter 213 detects gray level values of pixels at the odd-numbered frame and the even-numbered frame continuously inputted from the frequency converter 211 within a certain time, and thereafter calculates a low gray level conversion value and a high gray level conversion value intended to be converted with the aid of the detected gray level value and the predetermined reference gray level value. Subsequently, the gray level converter 213 changes gray levels of pixels at the odd-numbered and even-numbered frames into the respective calculated low gray level conversion value and high gray level conversion value to thereby convert the gray levels. As illustrated in (A) and (B) of FIG. 5, the gray level converter 213 converts a gray level value 'DG' of a pixel at the inputted odd-numbered frame into the calculated low gray level conversion value 'LG' and, at the same time, converts a gray level value 'DG' of a pixel at the inputted even-numbered frame into the calculated high gray level conversion value 'HG'.

The multiplexer 214 has a selection terminal connected to the output terminal of the frame discriminator 212, input terminals connected to the output terminal of the frequency converter 211 and to the output terminal of the gray level converter 213, and an output terminal connected to the frame output terminal.

Figure 6:
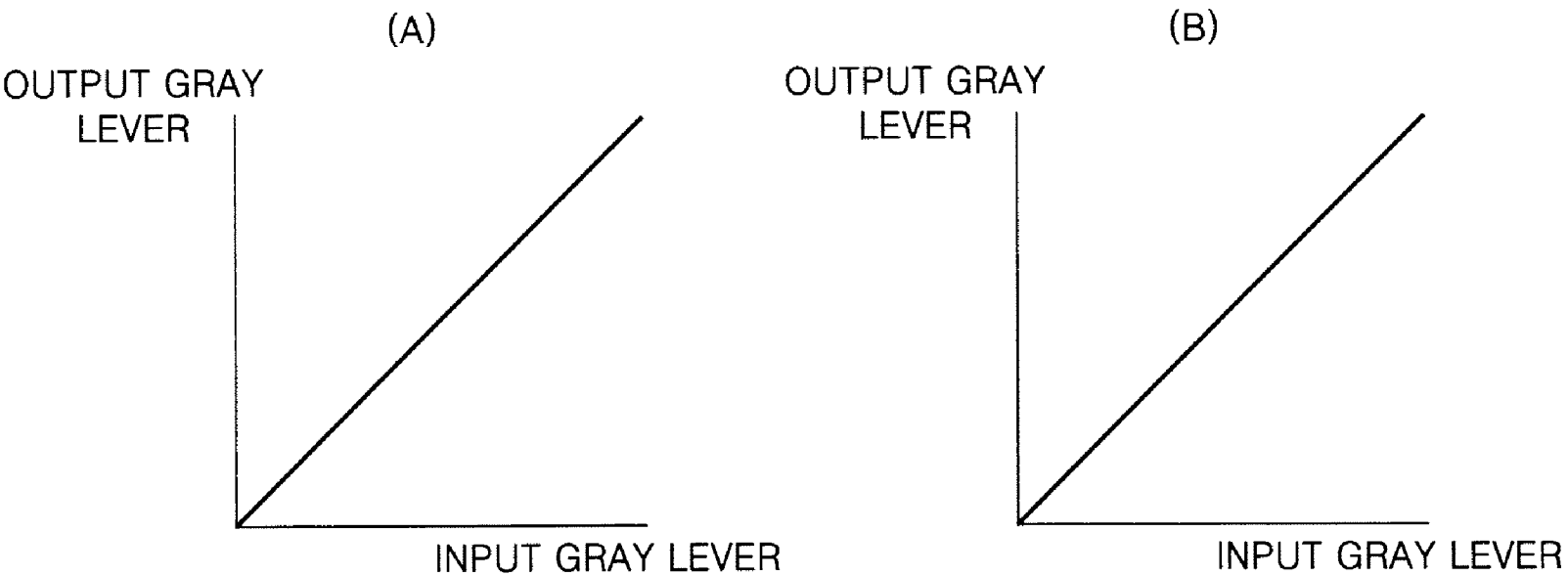
FIG. 6 is gray level characteristic diagrams of a still image frame in the liquid crystal display device according to the embodiment of the present invention.

If a first selection signal '0' indicating an output of a still image from the frame discriminator 212 is inputted to the selection terminal of the multiplexer 214, then the multiplexer 214 outputs the odd-numbered still image frame and the even-numbered still image frame substantially continuously inputted from the frequency converter 211 to the frame output terminal connected to the input terminal of the timing controller 220 in response to the first selection signal '0'. At this time, since the frequency converter 211 continuously outputs the same odd-numbered and even-numbered still image frames without converting gray level values of pixels at the still image frame, as illustrated in (A) and (B) of FIG. 6, the multiplexer 214 substantially continuously outputs the odd-numbered and even-numbered still image frames having the same gray level value to the timing controller 220.

If a second selection signal '1' indicating an output of a dynamic image from the frame discriminator 212 is inputted to the selection terminal of the multiplexer 214, then the multiplexer 214 outputs the odd-numbered and even-numbered dynamic frames substantially continuously inputted from the gray level converter 213 in response to the second selection signal '1'. At this time, the multiplexer 214 substantially continuously outputs the odd-numbered frame having a gray level value converted, as illustrated in (A) of FIG. 5, and the even-numbered frame having a gray level value converted as illustrated in (B) of FIG. 5.

Figure 7:
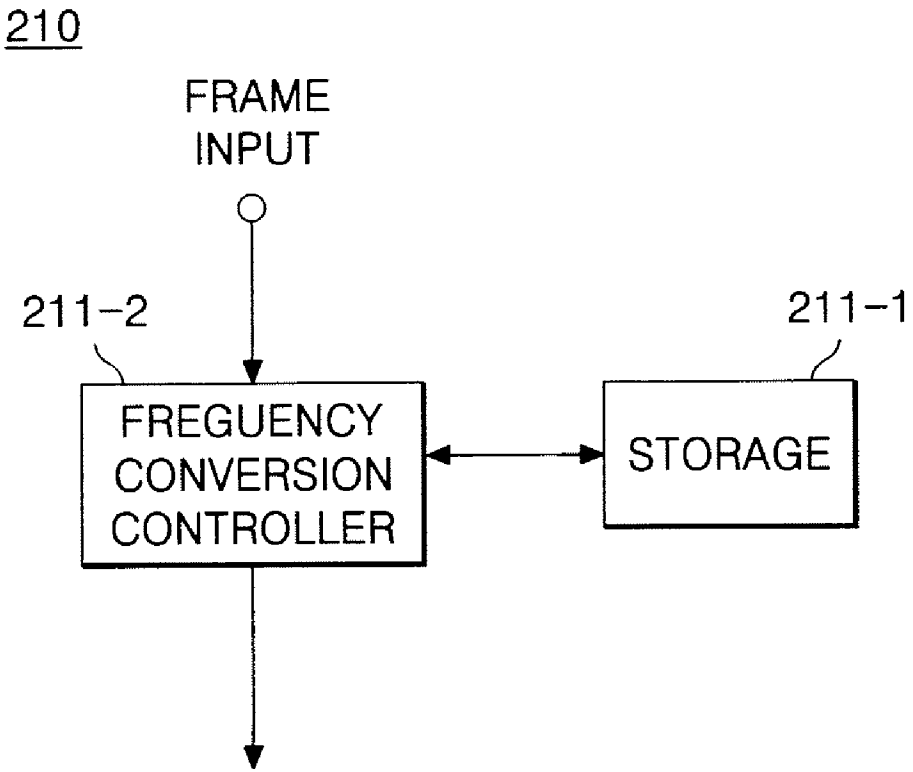
FIG. 7 is a block diagram of the frequency converter illustrated in FIG. 4.

FIG. 7 illustrates a configuration of the frequency converter in FIG. 4.

For example, referring to FIG. 7, the frequency converter 211 includes a storage unit 211-1 for temporarily storing the inputted current frame, and a frequency conversion controller 211-2 for temporarily storing the inputted current frame in the storage unit 211-1 and for reading out the frame at the storage unit 211-1 twice within a certain time such that the first frame frequency is output at a second frame frequency.

The storage unit 211-1 may be implemented by a virtual memory device for storing frame information. Such a storage unit 211-1 temporarily stores the current frame written by the frequency conversion controller 211-2.

When the current frame is inputted via the frame input terminal, the frequency conversion controller 211-2 temporarily stores the current frame into the storage unit 211-1, and thereafter reads out the frame at the storage unit 211-1 twice within a certain time to continuously output them to the gray level converter 213 and the input terminal of the multiplexer 214, thereby converting the first frame frequency into the second frame frequency.

Figure 8:
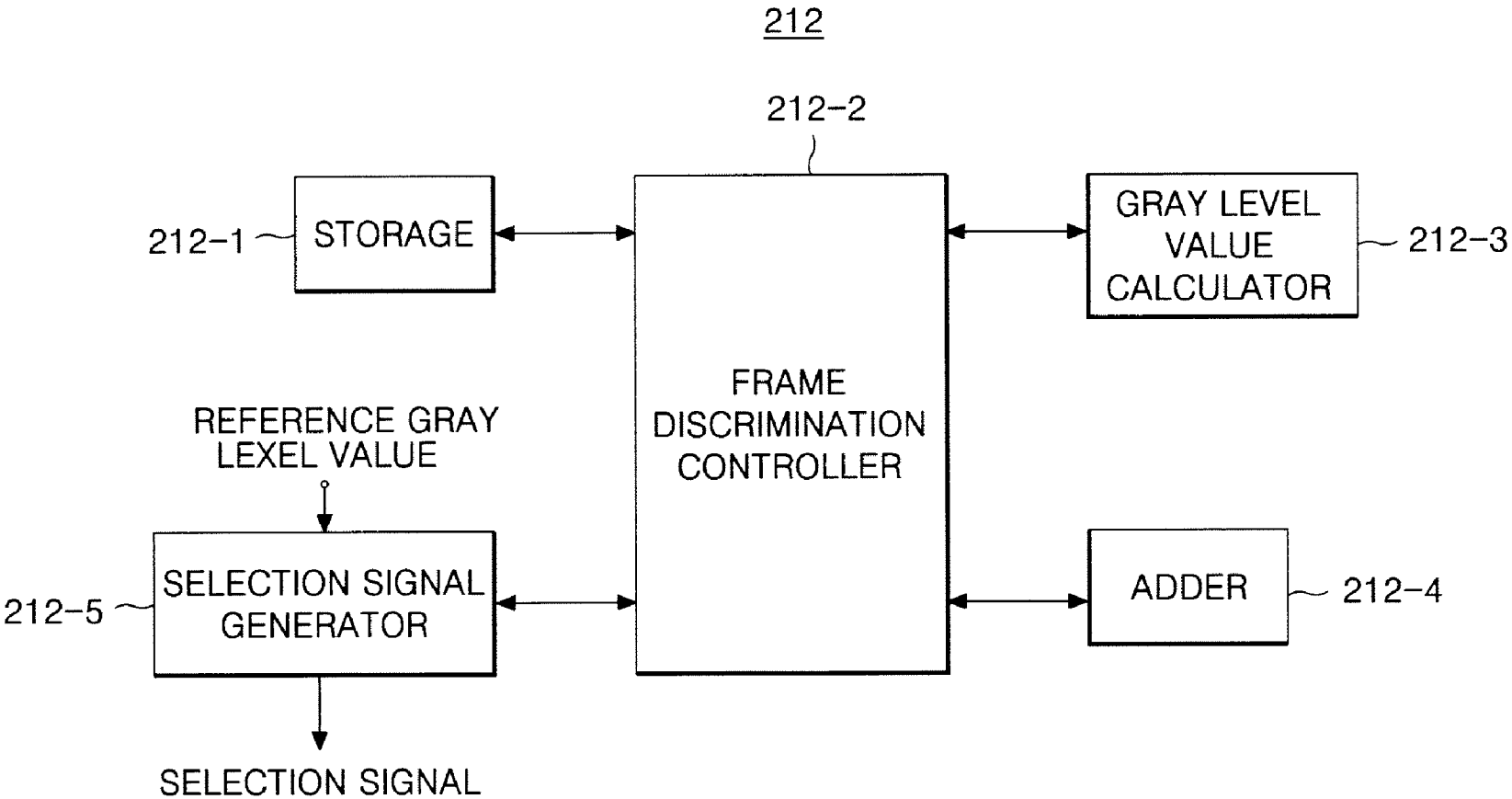
FIG. 8 is a block diagram of the frame discriminator illustrated in FIG. 4.

FIG. 8 illustrates a configuration of the frame discriminator in FIG. 4.

Referring to FIG. 8, the frame discriminator 212 includes a storage unit 212-1 for storing at least one previous frame of the inputted current frame, a frame discrimination controller 212-2 for storing the previous frame into the storage unit 212-2 and for reading out the previous frame in response to an input of the current frame to control a discrimination of an image state of the current frame, a gray level difference value calculator 212-3 for calculating gray level difference values between the corresponding pixels at the previous frame and the current frame under control of the frame discrimination controller 212-2, an adder 212-4 for adding the gray level difference values calculated by the gray level difference value calculator 212-3 to each other under control of the frame discrimination controller 212-2, and a selection signal generator 212-5 for comparing the sum with a predetermined reference gray level value to generate a first selection signal or a second selection signal in accordance with the compared result and output it to the multiplexer 214 under control of the frame discrimination controller 212-2.

The storage unit 212-2 stores at least one previous frame written by the frame discrimination controller 212-2.

The frame discrimination controller 212-2 stores the previous frame in the storage unit 212-2, and thereafter reads out at least one previous frame from the storage unit 212-1 when the current frame is inputted via the frame input terminal to output at least one previous frame and the current frame to the gray level value calculator 212-3. If the calculated gray level difference values are inputted from the gray level value calculator 212-3, then the frame discrimination controller 212-2 delivers the calculated gray level difference values into the adder 212-4. If the sum is inputted from the adder 212-4, then the frame discrimination controller 212-2 delivers the inputted sum to the selection signal generator 212-5.

When the current frame and the previous frame are inputted from the frame discrimination controller 212-2, the gray level difference value calculator 212-3 calculates gray level difference values of the corresponding pixels at the previous frame and the current frame to output them to the frame discrimination controller 212-2.

The present liquid crystal display device has been implemented such that the gray level difference value calculator 212-3 calculates gray level difference values with the aid of a single of previous frame and the current frame, but is not limited to this implementation. Alternatively, the present liquid crystal display device may be implemented such that the gray level difference value calculator 212-3 calculates gray level difference values with the aid of a plurality of previous frame and the current frame. In this case, the frame discrimination controller 212-2 reads out a plurality of previous frames from the storage unit 212-1 to deliver them into the gray level difference value calculator 212-3.

When the calculated gray level difference values are inputted from the gray level difference value calculator, the adder 212-4 adds all of the inputted gray level difference values to output the sum to the frame discrimination controller 212-2.

When the sum is inputted from the adder 212-4, the selection signal generator 212-5 compares the sum with a predetermined reference gray level value to generate a first selection signal or a second selection signal in accordance with the compared result and output it to the multiplexer 214. If the sum is smaller than the predetermined reference gray level value as a result of the comparison, then the selection signal generator 212-5 determines the current frame is a still image frame to generate a first selection signal '0' and outputs it to the multiplexer 214. On the other hand, if the sum is larger than the predetermined reference gray level value, then the selection signal generator 212-5 determines the current frame is a dynamic frame to generate a second selection signal '1' and output it to the multiplexer 214.

Figure 9:
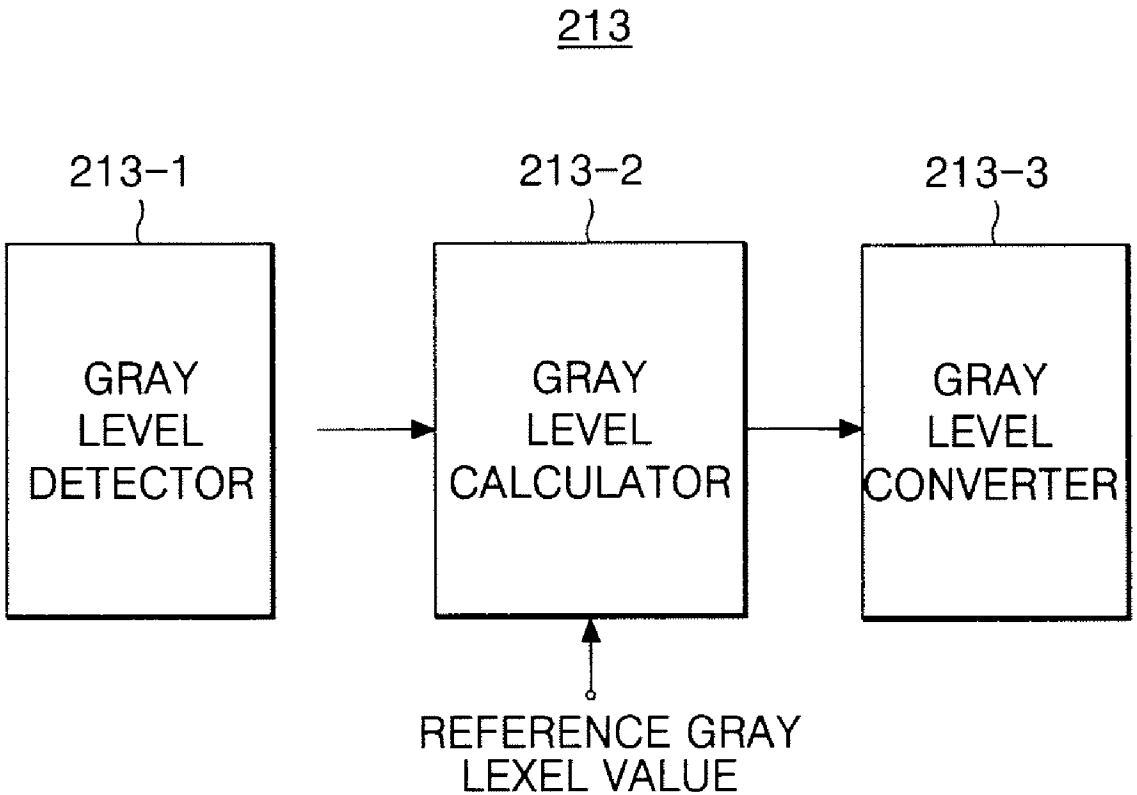
FIG. 9 is a block diagram of the gray level converter illustrated in FIG. 4.

FIG. 9 illustrates a configuration of the gray level converter in FIG. 4.

Referring to FIG. 9, the gray level converter 213 includes a gray level detector 213-1 for detecting gray level values of pixels at the odd-numbered frame and the even-numbered frame inputted substantially continuously from the frequency converter 211 within a certain time, a gray level calculator 213-2 for calculating a low gray level conversion value and a high gray level conversion value intended to be converted with the aid of a gray level value detected by the gray level detector 213-1 and a predetermined reference gray level value, and a gray level converter 213-3 for transiting gray levels of pixels at the odd-numbered frame and the even-numbered frame into a low gray level conversion value and a high gray level conversion value calculated by the gray level calculator 213-2, respectively, to convert the gray levels.

The gray level detector 213-1 detects gray level values of pixels at the odd-numbered frame and the even-numbered frame inputted substantially continuously from the frequency converter 211 within a certain time to output them to the gray level calculator 213-2.

The gray level calculator 213-2 subtracts the predetermined reference gray level value from a gray level value detected by the gray level detector 213-1 to calculate a low gray level conversion value intended to be converted and, at the same time, adds the predetermined reference gray level value to a gray level value detected by the gray level value detector 213-1 to calculate a high gray level conversion value intended to be converted. For instance, if a gray level value detected by the gray level detector 213-1 is '50 gray level' and the predetermined reference gray level value is '8 gray level', then the gray level calculator 213-2 subtracts the predetermined reference gray level value '8 gray level' from the detected gray level value '50 gray level' to calculate a low gray level conversion value '42 gray level' and, at the same time, adds the predetermined reference gray level value '8 gray level' to the detected gray level value '50 gray level' to calculate a high gray level conversion value '58 gray level', and outputs them to the gray level converter 213-3.

The gray level converter 213-3 changes gray levels of pixels at the odd-numbered frames of the same frames inputted substantially continuously within a certain time into low gray level conversion values calculated by the gray level calculator 213-2 to convert them into low gray levels and, while changing gray levels of pixels at the even-numbered frames into high gray level conversion values calculated by the gray level calculator 213-2 to convert them into high gray levels, and outputs them to the multiplexer 214. For instance, if a gray level value of a pixel at the inputted odd-numbered frame is '50 gray level' and the calculated low level conversion value is '42 gray level', then the gray level converter 213-3 converts a gray level of the pixel at the inputted odd-numbered frame into '42 gray level'. On the other hand, if a gray level value of a pixel at the inputted even-numbered frame is '50 gray level' and the calculated high gray level conversion value is '58 gray level', then the gray level converter 213-3 converts a gray level of the pixel at the inputted even-numbered frame into '58 gray level'.

Figure 5:
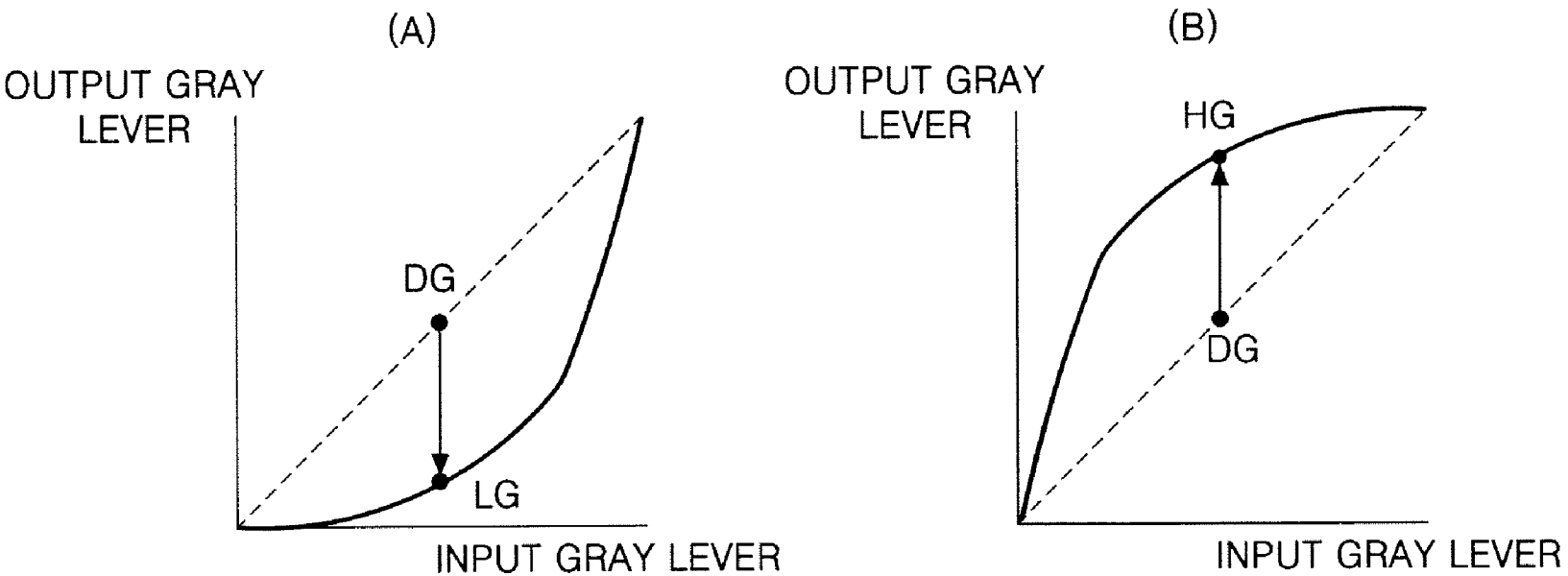
FIG. 5 is gray level conversion characteristic diagrams in the liquid crystal display device according to the embodiment of the present invention.

One gray level conversion scheme of the gray level converter 213-3 will be described with reference to FIG. 5. The gray level converter 213-3 converts a gray level value 'DG' of a pixel at the inputted odd-numbered frame, as illustrated in (A) of FIG. 5, into the calculated low gray level conversion value 'LG' and, while converting a gray level value 'DG' of a pixel at the inputted even-numbered frame, as illustrated in (B) of FIG. 5, into the calculated high level conversion value 'HG'.

As described above, the liquid crystal display device according to the present invention multiplies a frame frequency by the frequency converter 210 and thereafter converts gray level values of the same dynamic image frames driven substantially continuously within a certain time, while not converting gray level values of the same still image frames driven substantially continuously within a certain time, thereby minimizing a flicker from being generated at the still image frame due to the multiplication of the frame frequency and hence reducing a motion blur.

Hereinafter, a driving procedure of the liquid crystal display device according to the embodiment of the present invention having the above-mentioned configuration and function will be described with reference to flow charts.

Figure 10:
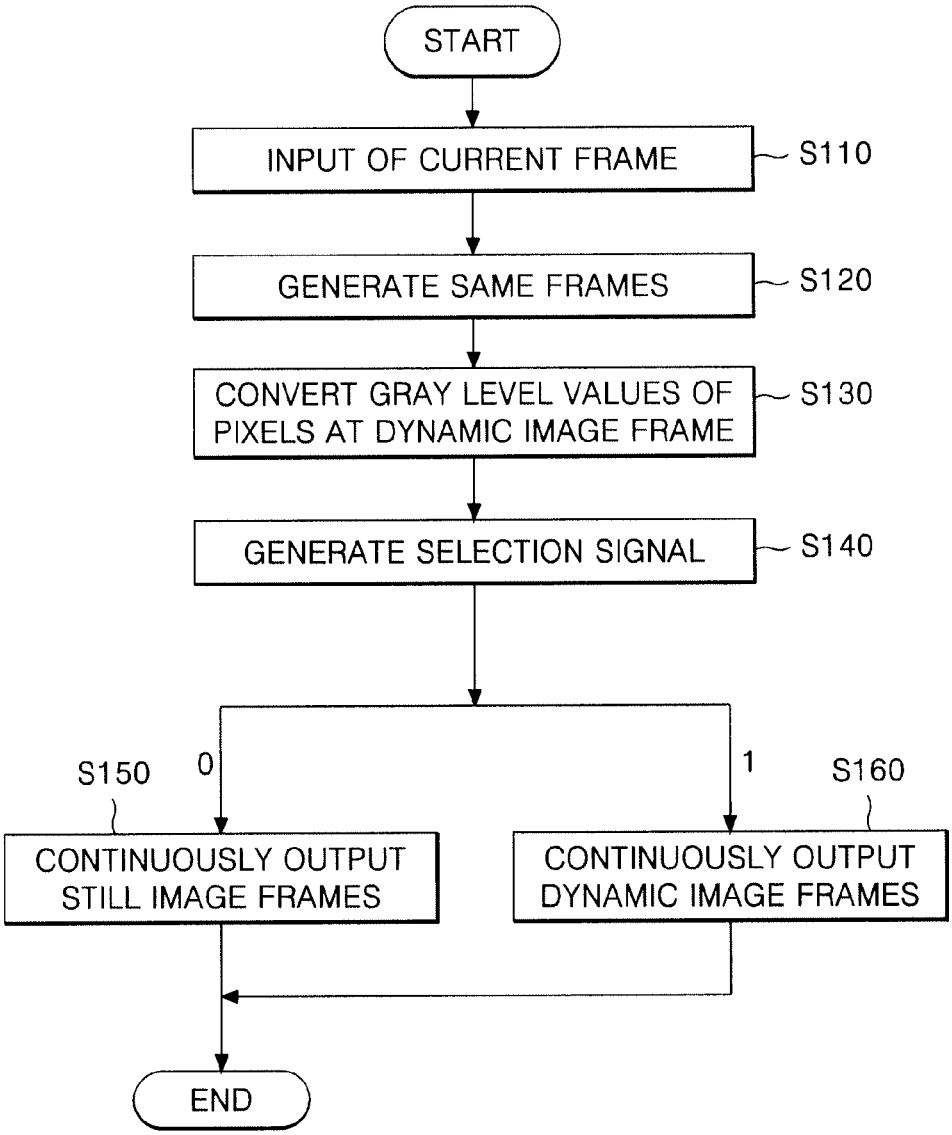
FIG. 10 is a flow chart for explaining a method of driving the liquid crystal display device according to the embodiment of the present invention.

FIG. 10 is a flow chart for explaining a method of driving the liquid crystal display device according to the embodiment of the present invention. Herein, there will be described a procedure of processing the current frame in such a state that the previous frame is stored in the frame discriminator 212.

Referring to FIG. 10, if the current frame inputted from a system is inputted via the frame input terminal at a step S110, then the frequency converter 211 temporarily stores the current frame and thereafter multiplies a first frame frequency into a second frame frequency to generate the same still image frames or the same dynamic image frames driven continuously with a certain time at a step S120. Further, at a step S130, the gray level converter 213 converts gray level values of pixels at the frames generated by the frequency converter 211 to be driven with the second frame frequency as illustrated in FIG. 5.

At this time, the frame discriminator 212 determines whether the current frame is a still image frame or a dynamic image frame with the aid of the previous frame stored in advance to thereby generate a first selection signal or a second selection signal in accordance with the determined result at a step S140.

If a first selection signal '0' is generated, then the multiplexer 214 continuously outputs the still image frames generated by the frequency converter 211 in response to the first selection signal '0' at a step S150.

On the other hand, if a second selection signal '1' is generated, then the multiplexer 214 continuously outputs the dynamic image frames having gray levels converted by the gray level converter 213 in response to the second selection signal '1' at a step S160.

As described above, the present liquid crystal display device substantially continuously outputs the same still image frames having frequencies multiplied by the frequency converter 211 via the multiplexer 214 within a certain time when the input frame is a still image frame, thereby allowing the same still image frames having gray levels being not inverted to be continuously driven within a certain time. Further, the present liquid crystal display devices selectively outputs only the dynamic image frames, of the frames in which frequencies are multiplied and thereafter gray level are converted by the gray level converter 213, via the multiplexer 214 when the input frame is a dynamic image frame, thereby allowing the dynamic image frames having the converted gray levels to be driven substantially continuously within a certain time.

Figure 11:
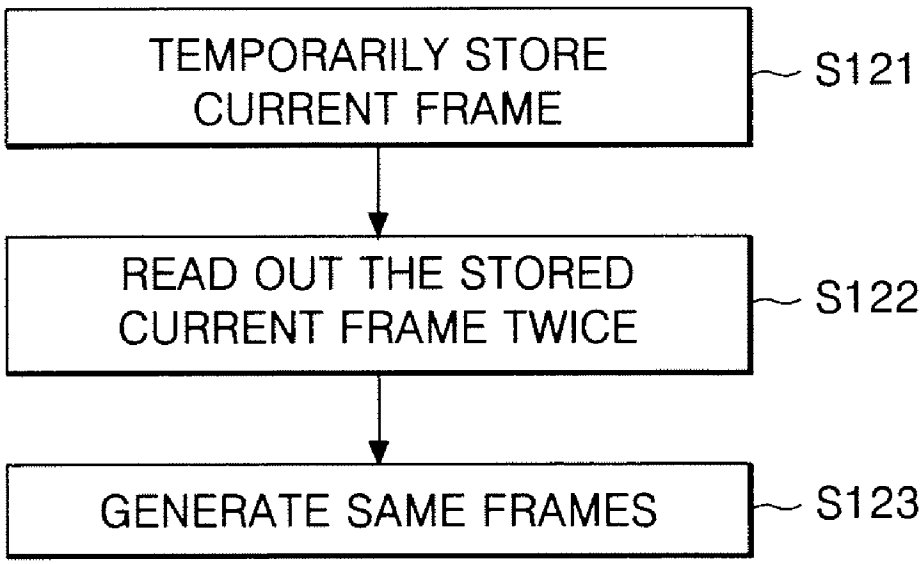
FIG. 11 is a detailed flow chart for illustrating the frame frequency conversion procedure in FIG. 10.

FIG. 11 is a detailed flow chart for illustrating the frame frequency conversion process in FIG. 10.

Referring to FIG. 11, if the current frame is inputted via the frame input terminal, then the frequency converter 211 temporarily stores the current frame at a step S121. In this state, the frequency converter 211 reads out the stored current frame twice within a certain time in order to multiply the first frame frequency into the second frame frequency at a step S122, and generates the same still image frames or the same dynamic image frames driven continuously within a certain time at a step S123.

Figure 12:
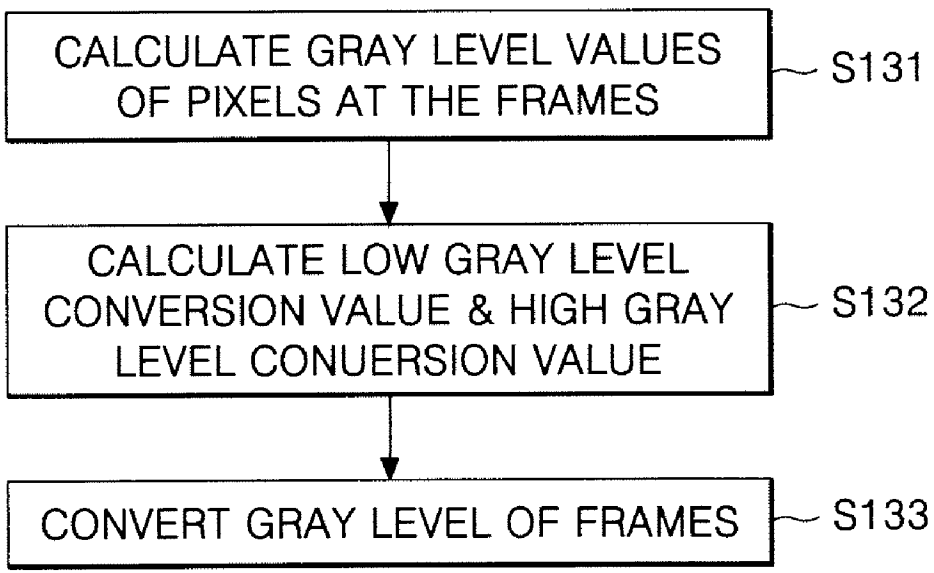
FIG. 12 is a detailed flow chart for illustrating a gray level value conversion procedure of the frames in FIG. 10.

FIG. 12 is a detailed flow chart for illustrating the gray level value conversion process of the frames in FIG. 10.

Referring to FIG. 12, if the frames generated by the frequency converter 211 are continuously inputted, then the gray level converter 213 detects gray level values of pixels at the inputted same frames at a step S131.

After the gray level values are detected in this manner, the gray level converter 213 subtracts a predetermined reference gray level value from the detected gray level value to calculate a low gray level conversion value intended to be converted and, at the same time, adds the predetermined reference gray level value to the detected gray level value to calculate a high gray level conversion value intended to be converted at a step S132.

Subsequently, at a step S133, the gray level converter 213 changes gray levels of pixels at the odd-numbered frame of the inputted same frames into the calculated low gray level conversion value to convert them into low gray levels and while changing gray levels of pixels at the even-numbered frame into the calculated high gray level conversion value to convert them high gray levels; and outputs them to the multiplexer 214.

Figure 13:
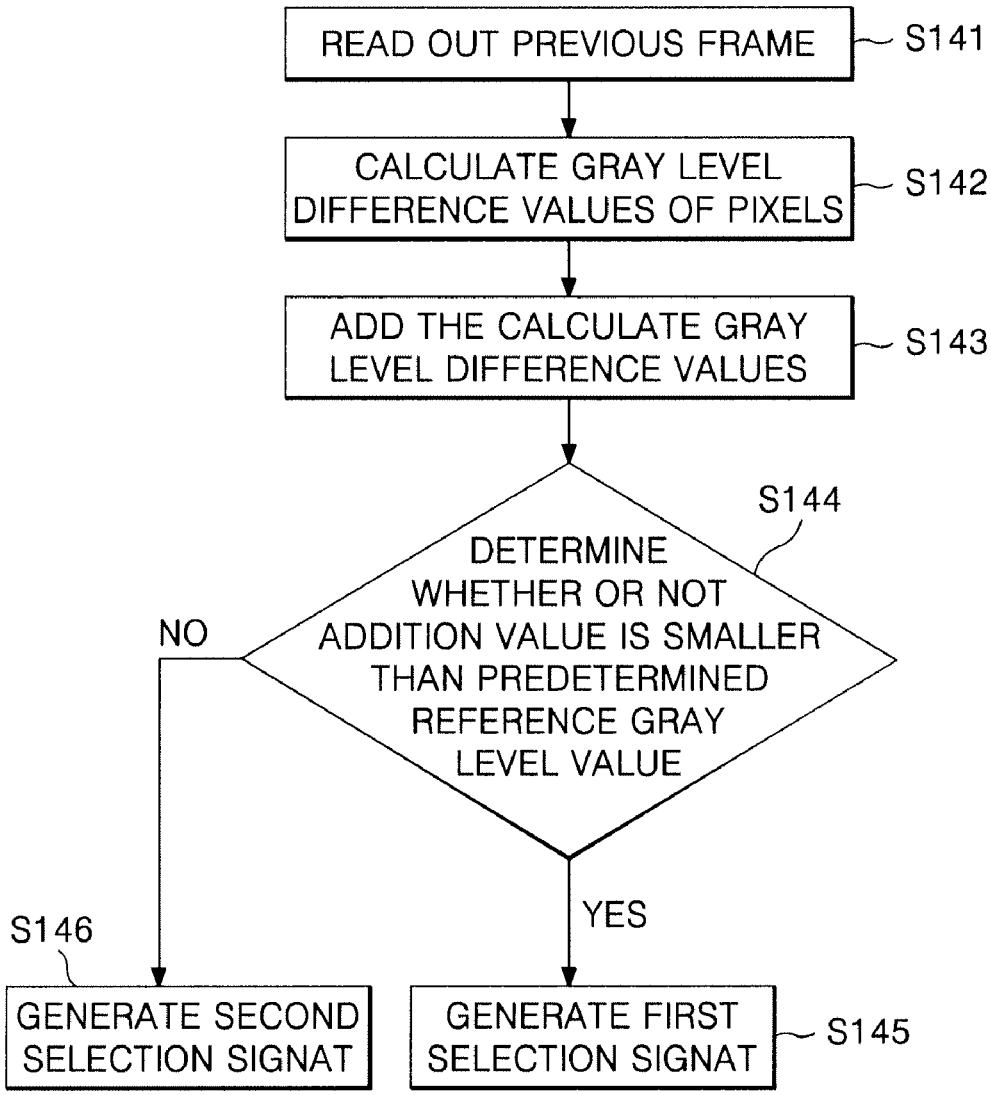
FIG. 13 is a detailed flow chart for illustrating a selection signal generation procedure in FIG. 10.

FIG. 13 is a detailed flow chart for illustrating the selection signal generation process in FIG. 10.

Referring to FIG. 13, the frame discriminator 212 reads out the stored previous frame when the current frame is inputted via the frame input terminal in such a state that the previous frame has been stored at a step S141. Next, the frame discriminator 212 calculates gray level difference values between the corresponding pixels of the previous frame and the current frame at a step S142 and thereafter adds all of the calculated gray level difference values to obtain an sum at a step S143.

Subsequently, the frame discriminator 212 compares the sum with the predetermined reference gray level value to determine whether or not the sum is smaller than the predetermined reference gray level value at a step S144. If the sum is smaller than the predetermined reference gray level value as a result of the determination, then the frame discriminator 212 determines the current frame to be a still image frame to thereby generate the first selection signal '0' at a step S145. On the other hand, if the sum is larger than the predetermined reference gray level value, then the frame discriminator 212 determines the current frame to be a dynamic image frame to thereby generate the second selection signal '1' at a step S146.

Figure 14:
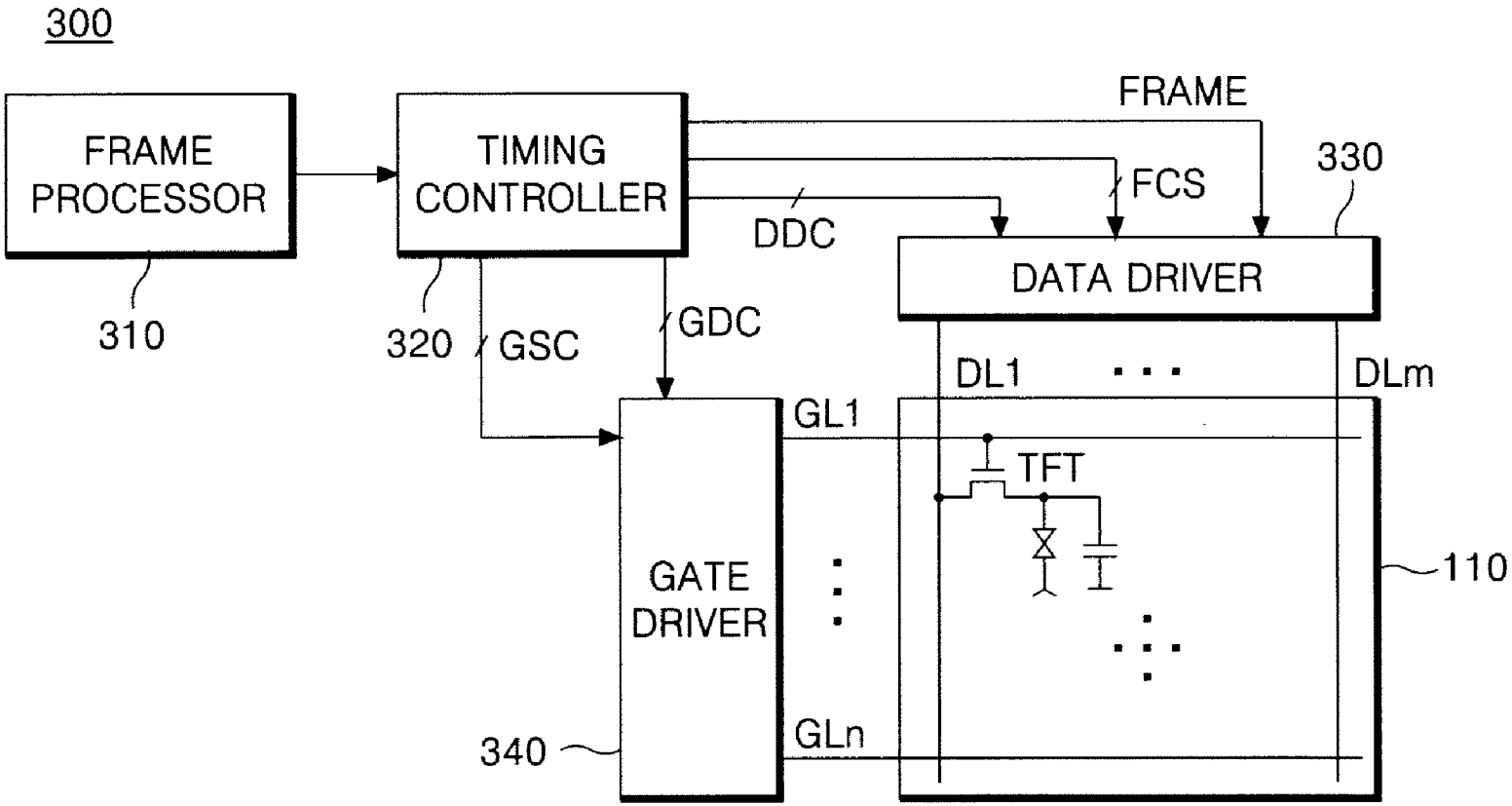
FIG. 14 is a block diagram illustrating a configuration of a liquid crystal display device according to another embodiment of the present invention.

FIG. 14 illustrates a configuration of a liquid crystal display device according to another embodiment of the present invention.

For the sake of understanding, the liquid crystal display device 300 of FIG. 14 includes a gamma reference voltage generator 140, a backlight assembly 150, an inverter 160, a common voltage generator 170 and a gate driving voltage generator 180 similar to the liquid crystal display device 100 as illustrated in FIG. 2. However, these elements are not illustrated for the sake of explanation convenience.

Referring to FIG. 14, the liquid crystal display device 300 includes a frame processor 310 for multiplying a frame frequency of an inputted current frame to generate the multiplied odd-numbered frame and the multiplied even-numbered frame, for detecting an edge area where a motion blur occurs from the multiplied odd-numbered frame and the multiplied even-numbered frame, and for converting gray levels of pixels positioned at the detected edge area, of pixels at the multiplied odd-numbered frame, into high gray levels and while converting gray levels of pixels positioned at the detected edge area, of pixels at the multiplied even-numbered frame, into low gray levels; a timing controller 320 for controlling a driving timing of the odd-numbered frame having a high gray level value multiplied and converted by the frame processor 310 and the even-numbered frame having a low gray level value multiplied and converted by the frame processor 310; a data driver 330 for continuously driving the odd-numbered frame and the even-numbered frame multiplied by the frame processor 310 within a certain time in response to a frame driving control signal from the timing controller 320, and a gate driver 340 for sequentially generating a scanning pulse in response to a gate driving control signal from the timing controller 320 to apply them to gate lines GL1 to GLn.

The frame processor 310 multiplies a frame frequency of the current frame inputted from a system to generate the multiplied odd-numbered frame and the multiplied even-numbered frame continuously within a certain time and detects an edge area at which a motion blur occurs from the multiplied odd-numbered frame and the multiplied even-numbered frame. Further, the frame processor 310 converts gray levels of pixels positioned at the detected edge area of pixels at the multiplied odd-numbered frame into high gray levels and while converting gray levels of pixels positioned at the detected edge area of pixels at the multiplied even-numbered frame into low gray levels and outputs them to the timing controller 320.

The timing controller 320 outputs the odd-numbered frame having a high gray level value multiplied and converted by the frame processor 310 to the data driver 330 and while applying a frame driving control signal FCS to the data driver 320 to thereby control a frame driving timing of the data driver 320. Further, the timing controller 320 outputs the even-numbered frame having a low gray level value multiplied and converted by the frame processor 310 to the data driver 330 and while applying the frame driving signal FCS to the data driver 330 to thereby control a frame driving timing of the data driver 330.

Furthermore, the timing controller 320 generates a data driving control signal DDC and a gate driving control signal GDC with the aid of horizontal/vertical synchronizing signals H and V (not shown) from the system in response to a clock signal CLK (not shown) from the system to apply them to the data driver 330 and the gate driver 340, respectively. The data driving control signal DDC includes a source shift clock SSC, a source start pulse SSP, a polarity control signal POL and a source output enable signal SOE, etc. The gate driving control signal GDC includes a gate start pulse GSP and a gate output enable signal GOE, etc.

The data driver 330 substantially continuously drives the odd-numbered frame having a high gray level value multiplied and converted by the frame processor 310 and the even-numbered frame having a low gray level value multiplied and converted by the frame processor 310 within a certain time in response to the frame driving control signal FCS from the timing controller 320.

The gate driver 340 sequentially generates a scanning pulse in response to the gate driving control signal GDC and the gate shift clock GSC from the timing controller 320 to apply them to the gate lines GL1 to GLn. Particularly, the gate driver 340 sequentially applies the scanning pulse to the gate lines GL1 to GLn when the odd-numbered frame, of the odd-numbered frame and the even-numbered frame having frame frequencies multiplied by the frame processor 310, is being driven, and thereafter sequentially applies the scanning pulse to the gate lines GL1 to GLn again when the even-numbered frame is being driven.

Figure 15:
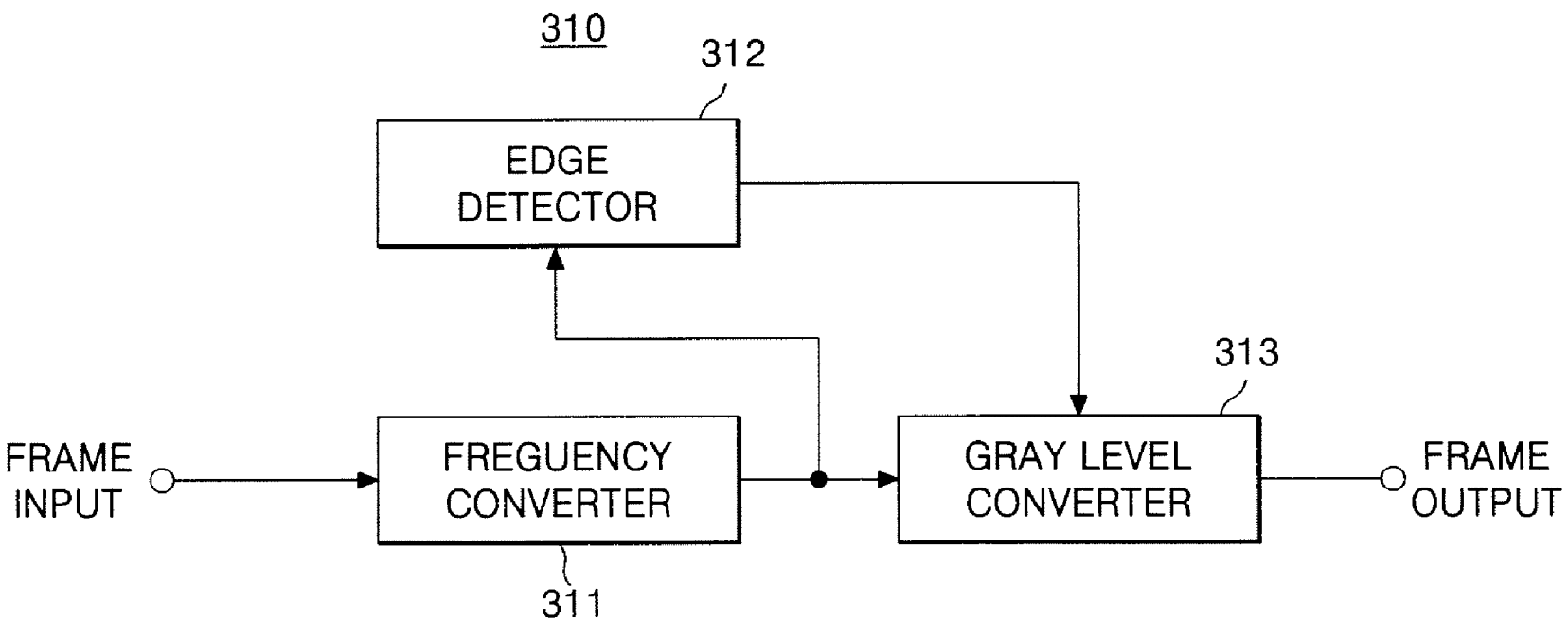
FIG. 15 is a block diagram of the frame processor illustrated in FIG. 14.

FIG. 15 illustrates a configuration of the frame process 310 in FIG. 14.

Referring to FIG. 15, the present liquid crystal display device 300 may include a frequency converter 311 for multiplying an inputted current frame to substantially continuously output the multiplied odd-numbered frame and the multiplied even-numbered frame within a certain time, an edge detector 312 for detecting an edge area at which a motion blur occurs from the multiplied odd-numbered frame and the multiplied even-numbered frame, and a gray level converter 313 for converting gray levels of pixels positioned at the detected edge area, of pixels at the odd-numbered frame multiplied by the frequency converter 311, into high gray levels and, at the same time, converting gray levels of pixels positioned at the detected edge area, of pixels at the multiplied even-numbered frame, into low gray levels.

The frequency converter 311 temporarily stores the inputted current frame, and thereafter multiplies the first frame frequency into the second frame frequency to substantially continuously read out the stored frame twice within a certain time, thereby outputting them to the gray level converter 313. Herein, the frequency converter 311 multiplies a frame frequency by a dynamic data insertion (DDI) system. More specifically, the frequency converter 311 temporarily stores the inputted current frame, and thereafter reads out them twice within a certain time to continuously output the same frames.

The present liquid crystal display device has been implemented such that the frequency converter 311 converts a first frame frequency of 60 Hz into a second frame frequency of 120 Hz when the current frame is inputted via the frame input terminal thereof, but is not limited to this implementation. For instance, the liquid crystal display device may be implemented such that the frequency converter 311 converts a first frame frequency of 50 Hz into a second frame frequency of 60 Hz.

The edge detector 312 detects an edge area at which a motion blur occurs from the multiplied odd-numbered frame and the multiplied even-numbered frame to output it to the gray level converter 313.

Figure 16A:
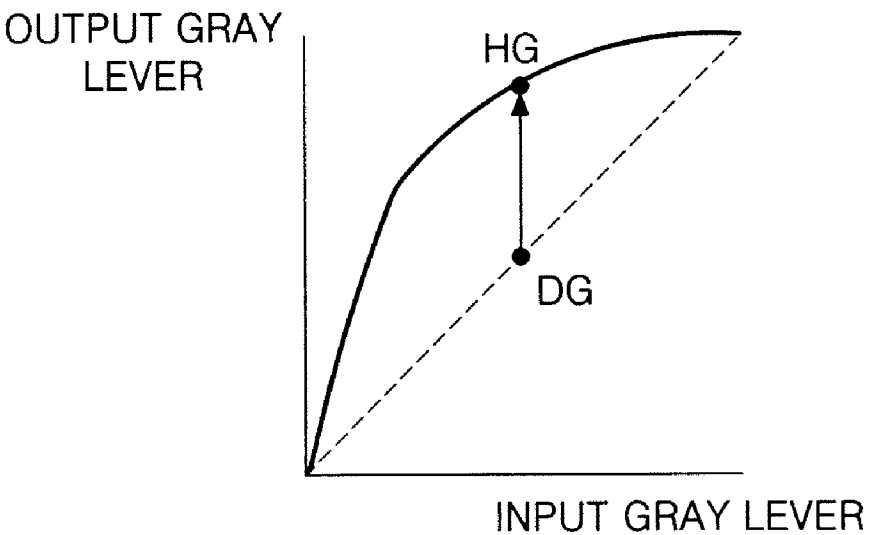
FIG. 16A and FIG. 16B are gray level conversion characteristic diagrams made by the gray level converter illustrated in FIG. 15.
Figure 16B:
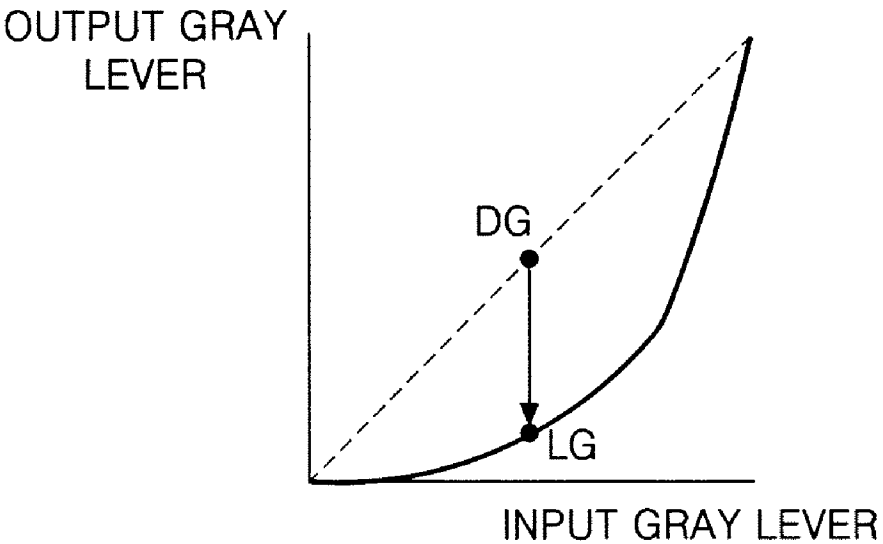

The gray level converter 313 converts gray levels of pixels positioned at the detected edge area, of pixels at the odd-numbered frame multiplied by the frequency converter 311, into high gray levels as illustrated in FIG. 16A while converting gray levels of pixels positioned at the detected edge area of pixels at the even-numbered frame multiplied by the frequency converter 311, into low gray levels as illustrated in FIG. 16B, and outputs them to the frame output terminal.

Figure 17:
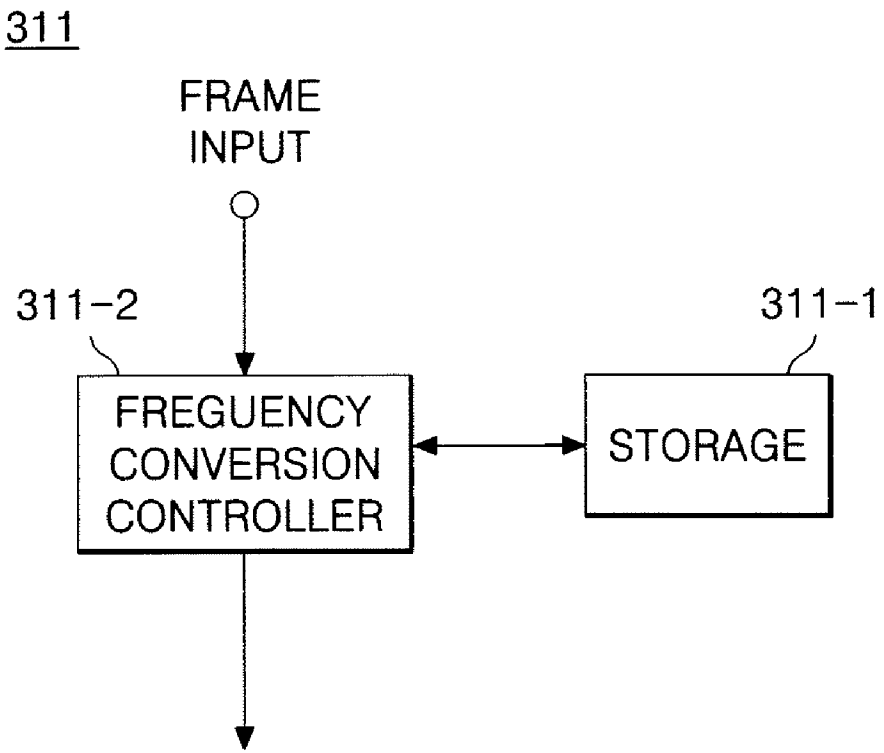
FIG. 17 is a block diagram of the frequency converter illustrated in FIG. 15.

FIG. 17 illustrates a configuration of the frequency converter in FIG. 15.

Referring to FIG. 17, the frequency converter 311 includes a storage unit 311-1 for temporarily storing the inputted current frame, and a frequency conversion controller 311-2 for temporarily storing the inputted current frame in the storage unit 311-1 and for reading out the frame at the storage unit 311-1 substantially continuously within a certain time such that the first frame frequency is multiplied into the second frame frequency.

The storage unit 311-1 may be implemented by a virtual memory which is a memory device for storing frame information. Such a storage unit 311-1 temporarily stores the current frame written by the frequency conversion controller 311-2.

When the current frame is inputted via the frame input terminal, the frequency conversion controller 311-2 temporarily stores the current frame into the storage unit 311-1, and thereafter reads out the frame at the storage unit 311-1 twice within a certain time to substantially continuously output them to the gray level converter 313, thereby converting the first frame frequency into the second frame frequency.

Figure 18:
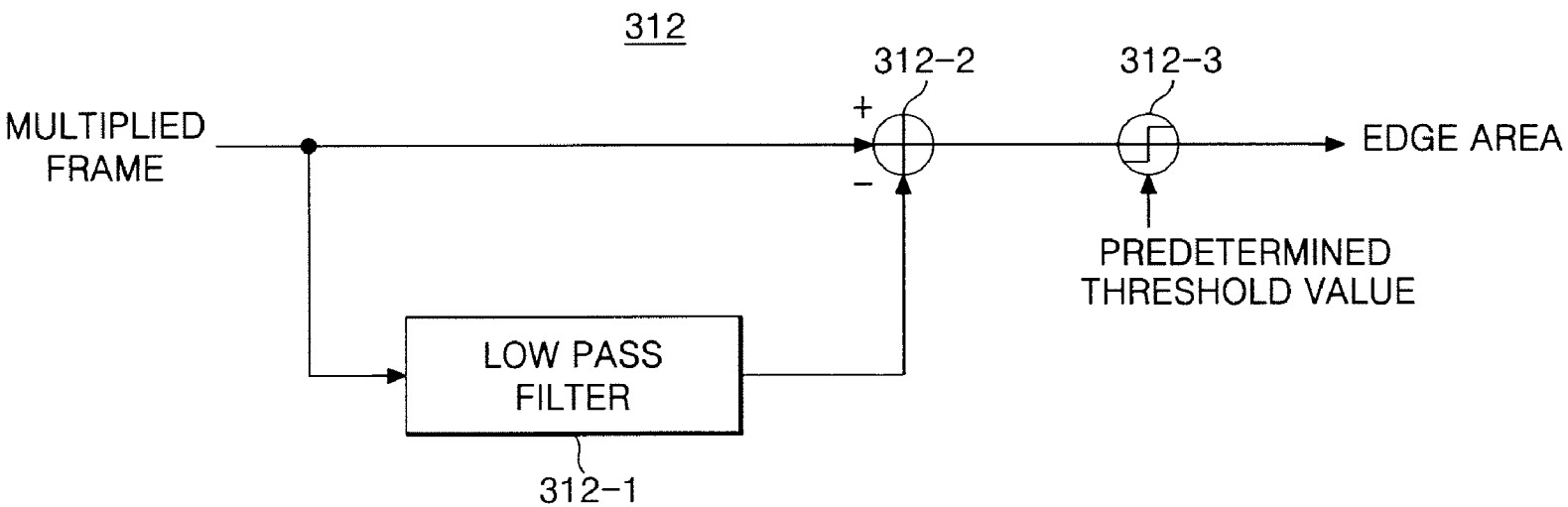
FIG. 18 is a block diagram of the edge detector illustrated in FIG. 15.

FIG. 18 illustrates a configuration of the edge detector in FIG. 15.

Referring to FIG. 18, the edge detector 312 includes a low pass filter 312-1 for reducing a gray level value at an interface area between pixels having a different gray level value, of pixels at the multiplied odd-numbered frame and the multiplied even-numbered frame, to smooth a gray level difference value between the pixels, an operating unit 312-2 for calculating a gray level difference value between the corresponding pixels, of pixels at the current frame and at the frame filtered by the low pass filter 312-1, and an edge detecting unit 312-3 for comparing gray level difference values calculated by the operating unit 312-2 with a predetermined threshold value to detect an edge area at which a motion blur occurs from the multiplied odd-numbered frame and the multiplied even-numbered frame.

The low pass filter 312-2 detects gray level values of pixels at the multiplied odd-numbered frame and the multiplied even-numbered frame, and thereafter calculates an average gray level value between a single of pixel positioned at the center and peripheral pixels positioned at the periphery, of the adjacent pixels, with the aid of the detected gray level values. The low pass filter 312-2 calculates an average gray level value of all the pixels at the multiplied odd-numbered frame and the multiplied even-numbered frame by the above-mentioned filtering scheme. The average gray level value calculated in this manner is a gray level value of the pixels at the filtered frame. More specifically, if it is assumed that the multiplied odd-numbered frame and the multiplied even-numbered frame should have pixels PX1 to PX42 as illustrated in FIG. 19, then the low pass filter 312-1 firstly detects gray level values of the pixels PX1 to PX42 and thereafter calculates an average gray level value between a single of pixel positioned at the center and peripheral pixels positioned at the periphery of the adjacent pixels, with the aid of the detected gray level values. For instance, the low pass filter 312-2 calculates an average gray level value between a single of pixel PX1 positioned at the center and the pixels PX2, PX7 and PX8 positioned at the periphery, of the adjacent pixels PX1, PX2, PX7 and PX8. Alternatively, the low pass filter 312-2 calculates an average gray level value between a single of pixel PX15 positioned at the center and the pixels PX8, PX9, PX10, PX14, PX16, PX20, PX21 and PX22 positioned at the periphery, of the adjacent pixels PX8, PX9, PX10, PX14, PX15, PX16, PX20, PX21 and PX22. An average gray level value for the pixels PX1 to PX42 at the multiplied odd-numbered frame and the multiplied even-numbered frame is calculated in this filtering method.

Figure 20A:
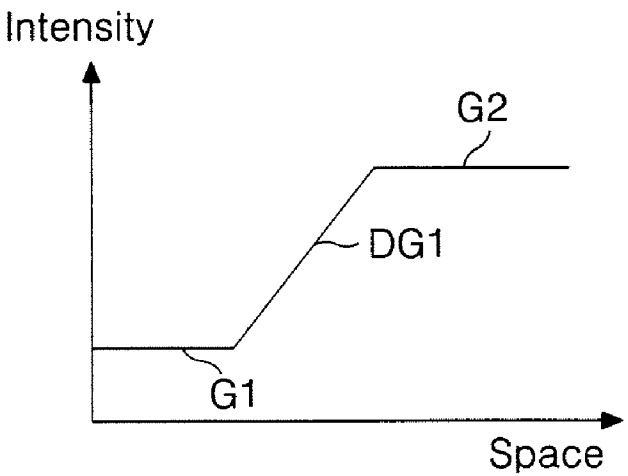
FIG. 20A is a gray level characteristic diagram of pixels at a frame inputted to the liquid crystal display device according to another embodiment of the present invention.
Figure 20B:
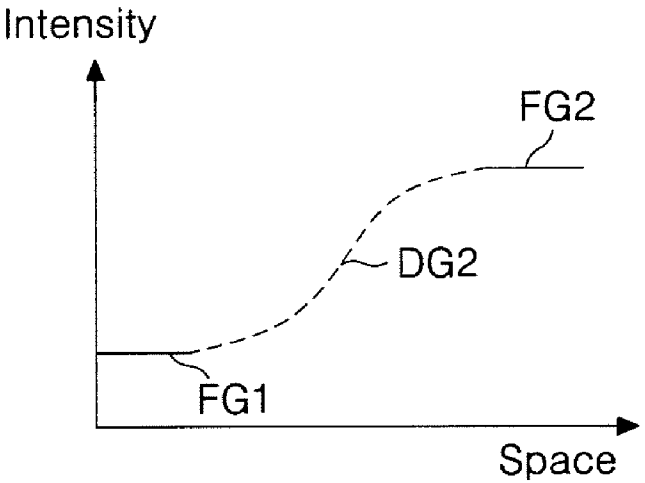
FIG. 20B is a gray level characteristic diagram of pixels at a frame filtered by the low pass filter illustrated in FIG. 18.

After the filtering was carried out by the low pass filter 312-2 as described above, a gray level value at the interface area between pixels having a different gray level value, of pixels at the multiplied odd-numbered frame and the multiplied even-numbered frame, is reduced to smooth a gray level difference value between the pixels. For example, as illustrated in FIG. 20A, an inclination indicating a gray level difference DG1 between a pixel having a relatively low gray level value G1 and a pixel having a relatively high gray level value G2 from the multiplied odd-numbered frame and the multiplied even-numbered frame makes a steep slope. Otherwise, as illustrated in FIG. 20B, an inclination indicating a gray level difference DG2 between a pixel having a relatively low gray level value FG1 and a pixel having a relatively high gray level value FG2 from the frame filtered by the low pass filter 312-1 makes a slow slope.

The operating unit 312-2 subtracts gray level values of pixels filtered by the low pass filter 312-2 from gray level values of pixels at the multiplied frame to calculate a gray level difference value between the corresponding pixels, of pixels at the multiplied frame and at the filtered frame, and output it to the edge detector 312-2.

Figure 21A:
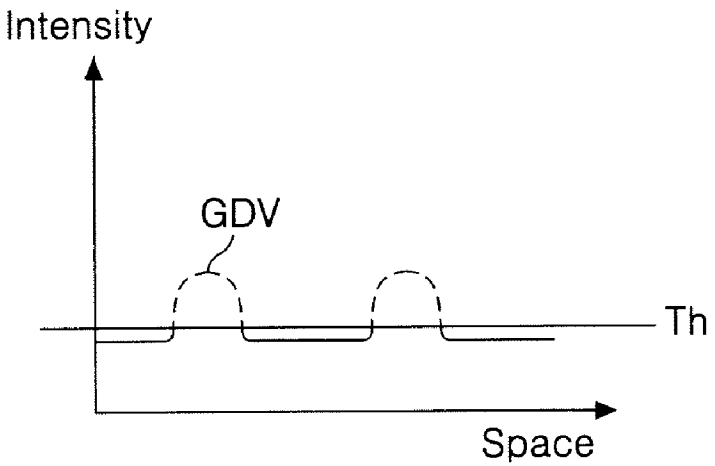
FIG. 21A illustrates an edge detecting method of the edge detector illustrated in FIG. 18.
Figure 21B:
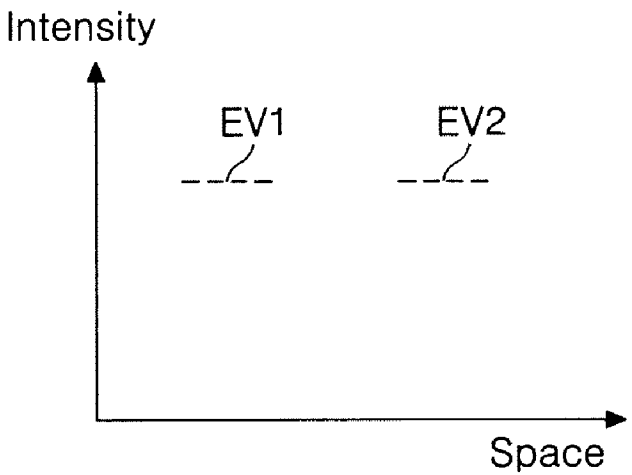
FIG. 21B illustrates an edge characteristic detected by the edge detector illustrated in FIG. 18.

The edge detector 312-3 compares gray level difference values calculated by the operating unit 312-2 with the predetermined threshold value to detect an edge area at which a motion blur occurs from the multiplied frame, and outputs an edge value indicating the detected edge area to the gray level converter 313. More specifically, with reference to FIG. 21A and FIG. 21B, the edge detector 312-3 compares the calculated gray level difference value GDV with the predetermined threshold value Th as illustrated in FIG. 21A. As a result of the comparison, the edge detector 312-2 detects a pixel area given by a gray level difference value higher than the predetermined threshold value to be an edge area while determining a pixel area given by a low gray level difference value lower than the predetermined threshold value to be no edge area. After the edge area was detected in this manner, the edge detector 312-3 outputs edge values EV1 and EV2 indicating the edge area to the gray level converter 313.

Figure 22:
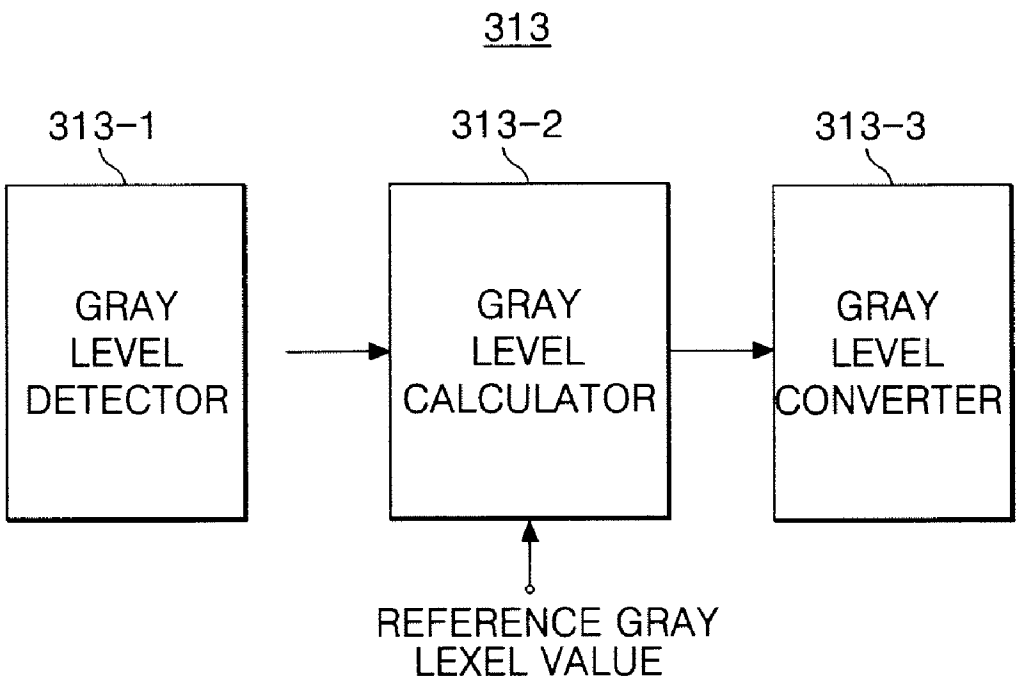
FIG. 22 is a block diagram of the gray level converter illustrated in FIG. 15.

FIG. 22 illustrates a configuration of the gray level converter in FIG. 15.

Referring to FIG. 22, the gray level converter 313 includes a gray level detector 213-1 for detecting gray level values of pixels positioned at the detected edge area, of pixels at the odd-numbered frame multiplied by the frequency converter 311, and, at the same time, detecting gray level values of pixels positioned at the detected edge area, of pixels at the multiplied even-numbered frame, a gray level calculator 313-2 for calculating a low gray level conversion value and a high gray level conversion value intended to be converted with the aid of a gray level value detected by the gray level detector 313-1 and a predetermined reference gray level value, and a gray level converting unit 313-3 for transiting gray levels of pixels positioned at the detected edge area, of the multiplied odd-numbered frame, into the calculated high gray level conversion value to convert them into high gray levels and, at the same time, transiting gray levels of pixels positioned at the detected edge area, of the multiplied even-numbered frame, into the calculated low gray level conversion value to convert them into low gray levels.

The gray level detector 313-1 detects gray level values of pixels positioned at the detected edge area, of pixels at the odd-numbered frame multiplied by the frequency converter 311, to output them to the gray level calculator 313-2; while detecting gray level values of pixels positioned at the detected edged area, of pixels at the multiplied even-numbered frame, to output them to the gray level calculator 313-2.

The gray level calculator 313-2 adds the predetermined reference gray level value to gray level values of pixels positioned at the edge area of the multiplied odd-numbered frame to calculate a high gray level conversion value intended to be converted and, at the same time, subtract the predetermined reference gray level value from gray level values of pixels positioned at the edge area of the multiplied even-numbered frame to calculate a low gray level conversion value intended to be converted, and outputs them to the gray level converter 313-3. For instance, if a gray level value of a pixel at the odd-numbered frame detected by the gray level detector 313-1 is '50 gray level' and the predetermined reference gray level value is '8 gray level', then the gray level calculator 313-2 adds a gray level value '50 gray level' of a pixel positioned at the edge area of the multiplied odd-numbered frame to the predetermined reference gray level value '8 gray level' to calculate a high gray level conversion value '58 gray level'. Further, if a gray level value of a pixel at the even-numbered frame detected by the gray level detector 313-1 is '50 gray level' and the predetermined reference gray level value is '8 gray level', then the gray level calculator 313-2 subtracts the predetermined reference gray level value '8 gray level' from a gray level value '50 gray level' of a pixel positioned at the edge area of the multiplied even-numbered frame to calculate a low gray level conversion value '42 gray level'.

The gray level converter 313-3 changes gray levels of pixels positioned at the detected edge area, of pixels at the multiplied odd-numbered frame, into the calculated high gray level conversion values to convert them into high gray levels and, at the same time, changes gray levels of pixels positioned at the detected edge area, of pixels at the multiplied even-numbered frame, into the calculated low gray level conversion value to convert them into low gray levels; and outputs them to the frame output terminal of the input terminal of the timing controller 320. For instance, if a gray level value of a pixel positioned at the edge area of the multiplied odd-numbered frame is '50 gray level' and the calculated high level conversion value is '58 gray level', then the gray level converter 313-3 converts a gray level of the pixel positioned at the edge area of the multiplied odd-numbered frame into '58 gray level'. On the other hand, if a gray level value of a pixel positioned at the edge area of the multiplied even-numbered frame is '50 gray level' and the calculated low gray level conversion value is '42 gray level', then the gray level converter 313-3 converts a gray level of the pixel at the multiplied even-numbered frame into '42 gray level'.

A gray level conversion scheme of the gray level converter 313-3 will be described with reference to FIG. 16A and FIG. 16B. The gray level converter 313-3 converts a gray level value 'DG' of a pixel positioned at the edge area of the multiplied odd-numbered frame as illustrated in FIG. 16A into the calculated high gray level conversion value 'HG' and, at the same time, converts a gray level value 'DG' of a pixel positioned at the edge area of the multiplied even-numbered frame as illustrated in FIG. 16B into the calculated low gray level conversion value 'LG'.

As described above, the liquid crystal display device according to the present invention multiplies a frame frequency by the frequency converter 311 and thereafter converts only gray level values of pixels positioned at the edge areas of the same frames driven continuously within a certain time, thereby reducing a brightness difference of the entire field caused by a gray level data insertion and hence reducing a motion blur caused by the brightness difference as well as a flicker.

Hereinafter, a driving procedure of the liquid crystal display device according to another embodiment of the present invention having the above-mentioned configuration and function will be described with reference to flow charts.

Figure 23:
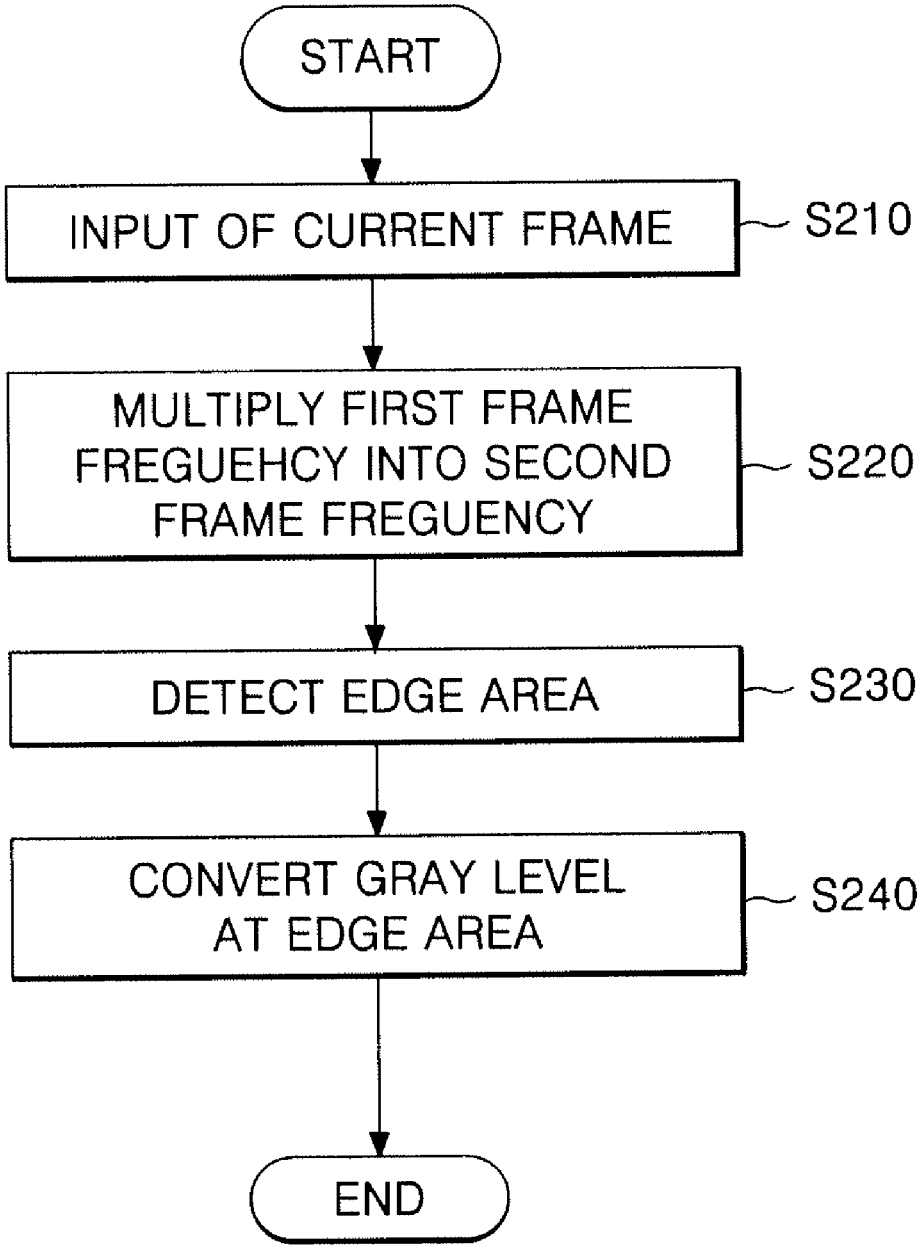
FIG. 23 is a flow chart for explaining a method of driving the liquid crystal display device according to another embodiment of the present invention.

FIG. 23 is a flow chart for explaining a method of driving the liquid crystal display device according to another embodiment of the present invention.

Referring to FIG. 23, if the current frame inputted from a system is inputted via the frame input terminal at a step S210, then the frequency converter 311 temporarily stores the current frame and thereafter multiplies a first frame frequency into a second frame frequency to generate the same frames driven continuously with a certain time at a step S220. At this time, the edge detector 312 detects an edge area at which a motion blur occurs from the multiplied frame to output it to the gray level converter 313 at a step S230.

Subsequently, at a step S240, the gray level converter 313 converts gray levels of pixels positioned at the detected edge area, of pixels at the odd-numbered frame multiplied by the frequency converter 311, into high gray levels as illustrated in FIG. 16A, while converting gray levels of pixels positioned at the detected edge area, of pixels at the even-numbered frame multiplied by the frequency converter 311, into low gray levels as illustrated in FIG. 16B.

As described above, the present liquid crystal display device converts only gray level values of the pixels positioned at the edge area where a motion blur occur, of pixels at the multiplied frame, and continuously drives the odd-numbered and even-numbered frames in which gray level values of pixels at the edge area have been converted in this manner within a certain time.

Figure 24:
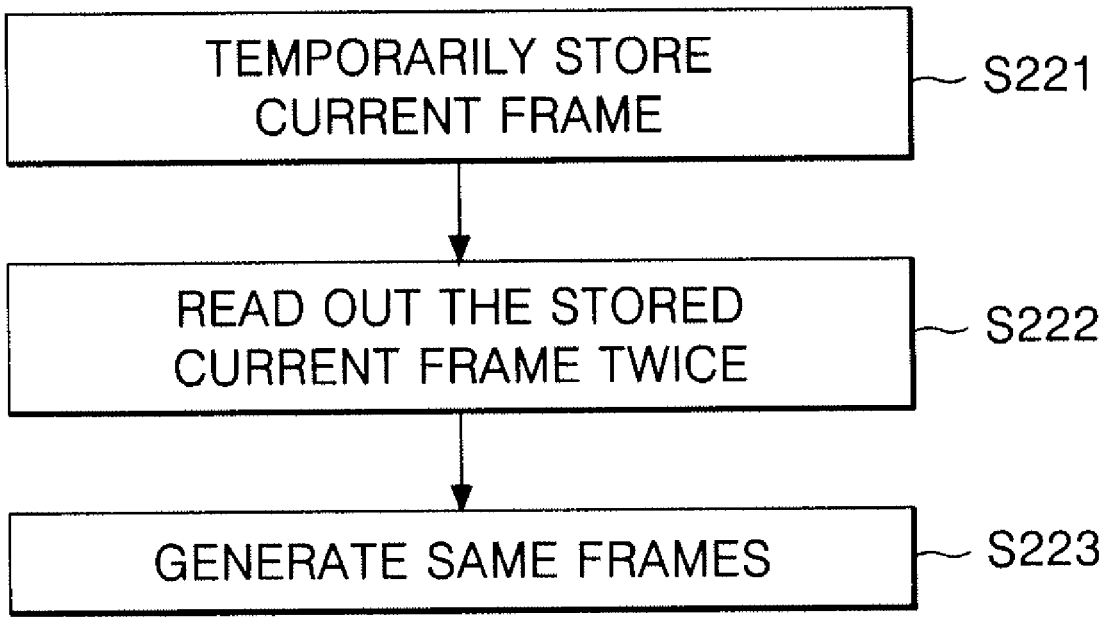
FIG. 24 is a detailed flow chart for illustrating the frame frequency conversion procedure in FIG. 23.

FIG. 24 is a detailed flow chart for illustrating the frame frequency conversion process in FIG. 23.

Referring to FIG. 24, if the current frame is inputted via the frame input terminal, then the frequency converter 311 temporarily stores the current frame at a step S221. In this state, the frequency converter 311 reads out the stored current frame twice within a certain time in order to multiply the first frame frequency into the second frame frequency at a step S222, and generates the same odd-numbered frame and the same even-numbered frame driven continuously within a certain time at a step S223.

Figure 25:
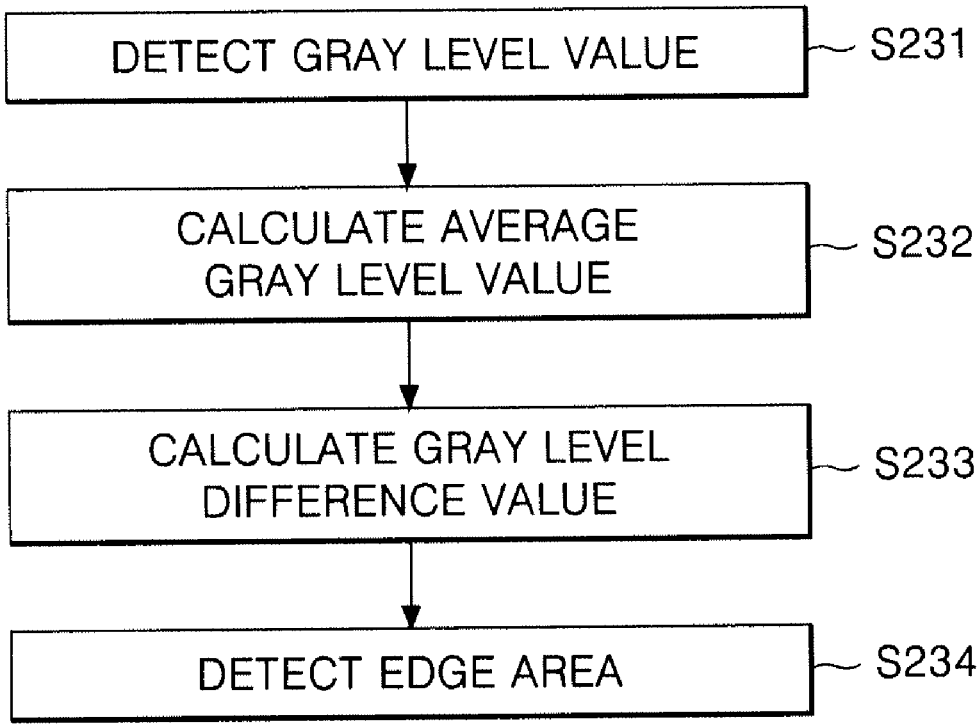
FIG. 25 is a detailed flow chart for illustrating the edge detection procedure in FIG. 23.

FIG. 25 is a detailed flow chart for illustrating the edge detection process in FIG. 23.

Referring to FIG. 25, the edge detector 312 detects gray level values of pixels at the multiplied frame at a step S231 and thereafter calculates an average gray level value between a single of pixel located at the center and peripheral pixels located at the periphery, of the adjacent pixels, with the aid of the detected gray level values at a step S232. After a filtering of the multiplied frame was carried out in this manner, a gray level value at the interface area between pixels having a different gray level value, of pixels of the multiplied frame, is reduced to smooth a gray level difference value between the pixels.

After the filtering, the edge detector 312 subtracts gray level values of the filtered pixels from gray level values of pixels at the multiplied frame to calculate a gray level difference value between the corresponding pixels, of pixels at the multiplied frame and at the filtered frame at a step S233.

Subsequently, the edge detector 312 compares the calculated gray level difference values with the predetermined threshold value to detect an edge area at which a motion blur occurs from the multiplied frame at a step S234. In this detection process, the edge detector 312 compares the calculated gray level difference values with the predetermined threshold value, and detects a pixel area given by a gray level difference value higher than the predetermined threshold value to be an edge area, as a result of the comparison, while determining a pixel area given by a gray level difference value lower than the predetermined threshold value to be no edge area.

Figure 26:
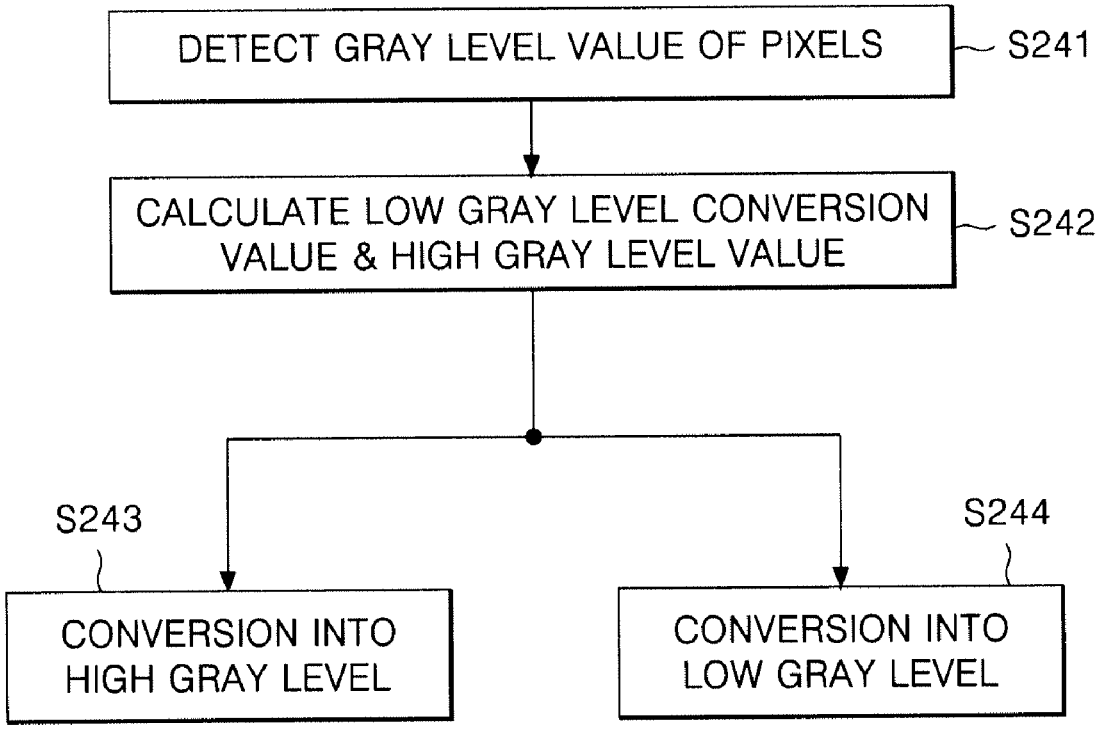
FIG. 26 is a detailed flow chart for illustrating the gray level conversion procedure in FIG. 23.

FIG. 26 is a detailed flow chart for illustrating the gray level conversion process of the frames in FIG. 23.

Referring to FIG. 26, if the odd-numbered and even-numbered frames multiplied by the frequency converter 311 are continuously inputted and, at the same time, an edge value detected by the edge detector 312, then the gray level converter 313 detects gray level values of pixels positioned at the detected edge area, of pixels at the multiplied odd-numbered frame, and detects gray level values of pixels positioned at the detected edge area, of pixels at the multiplied even-numbered frame at a step S241.

After the gray level values are detected in this manner, the gray level converter 313 adds the predetermined reference gray level value to gray level values of pixels positioned at the edge area at the multiplied odd-numbered frame to calculate a high gray level conversion value intended to be converted; and subtracts the predetermined reference gray level value from gray level values of pixels at the edge area of the multiplied even-numbered frame to calculate a low gray level conversion value intended to be converted at a step S242.

Subsequently, the gray level converter 313 changes gray levels of pixels positioned at the detected edge area, of pixels at the multiplied odd-numbered frame, into high gray levels at a step S243, and changes gray levels of pixels positioned at the detected edge area, of pixels at the multiplied even-numbered frame, into low gray levels at a step S244.

Figure 27:
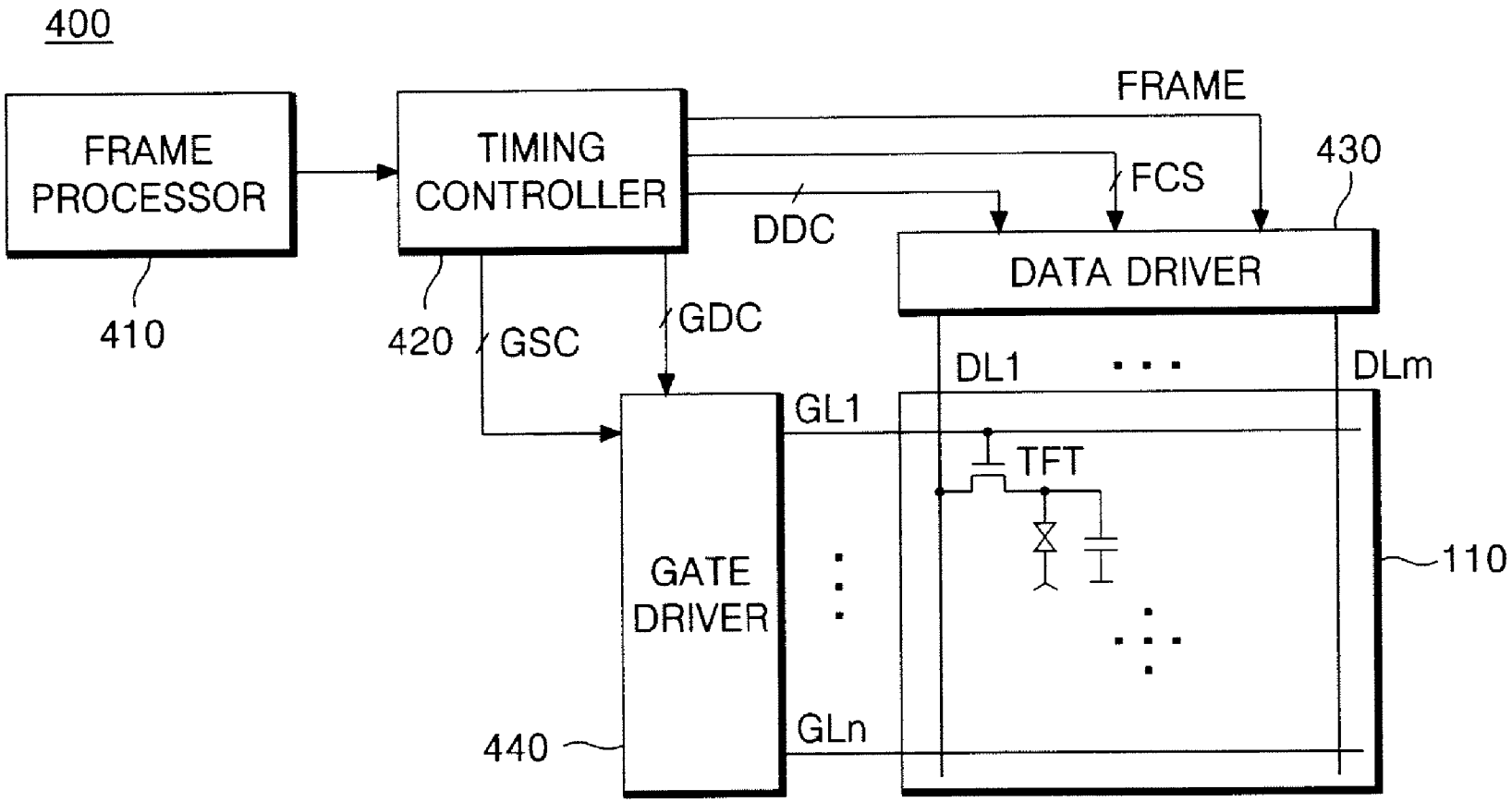
FIG. 27 is a block diagram showing a configuration of a liquid crystal display device according to still another embodiment of the present invention.

FIG. 27 shows a configuration of a liquid crystal display device according to still another embodiment of the present invention.

Referring to FIG. 27, the liquid crystal display device 400 includes a frame processor 410 for multiplying a frame frequency of an inputted current frame to produce the multiplied odd-numbered frames and the multiplied even-numbered frames and for outputting the multiplied odd-numbered and even-numbered still image frames without converting gray level values when the current frame is a still image frame while outputting pixels positioned at the edge area, of pixels at the multiplied odd-numbered and even-numbered dynamic image frames, with converting gray level values when the current frame is a dynamic image frame, a timing controller 420 for controlling a driving timing of the odd-numbered frames and the even-numbered frames multiplied by means of the frame processor 410, a data driver 430 for continuously driving the odd-numbered frames and the even-numbered frames multiplied by the frame processor 410 within a certain time with respect to the liquid crystal display panel 110 in response to a frame driving control signal from the timing controller 420, and a gate driver 440 for sequentially generating a scanning pulse in response to a gate driving control signal from the timing controller 420 to apply it to gate lines GL1 to GLn.

The frame processor 410 multiplies a frame frequency of the current frame inputted from a system to generate the same frames continuously driven within a certain time, and determines whether the current frame is a still image frame or a dynamic image frame to selectively generate a first selection signal and a second selection signal in accordance with the determined result. Herein, the frame processor 410 generates the first selection signal indicating an output of the still image frame when the current frame is a still image frame, whereas it generates the second selection signal indicating an output of the dynamic image frame when the current frame is a dynamic image frame.

The frame processor 410 detects an edge area at which a motion blur occurs from the multiplied odd-numbered frame and the multiplied even-numbered frame. Thereafter, the frame processor 410 converts gray levels of pixels positioned at the detected edge area, of pixels at the multiplied odd-numbered frame, into high gray levels and, at the same time, converts gray levels of pixels positioned at the detected edge area, of pixels at the multiplied even-numbered frame, into low gray levels.

Further, the frame processor 410 outputs the multiplied odd-numbered still image frame and the multiplied even-numbered still image frame to the timing controller 420 without converting gray level values in response to the first selection signal, or outputs the multiplied odd-numbered dynamic image frame and the multiplied even-numbered dynamic image frame, at which gray level values of pixels positioned at the detected edge area are converted, to the timing controller 420 in response to the second selection signal.

The timing controller 420 outputs the odd-numbered still image frame and the even-numbered still image frame multiplied by the frame processor 410 to the data driver continuously within a certain time and, at the same time, applies a frame driving control signal FCS to the data driver 420 to thereby control a frame driving timing of the data driver 420. Further, the timing controller 420 generates a data driving control signal DDC and a gate driving control signal GDC with the aid of horizontal/vertical synchronizing signals H and V from the system in response to a clock signal CLK from the system to apply them to the data driver 430 and the gate driver 440, respectively. Herein, the data driving control signal DDC includes a source shift clock SSC, a source start pulse SSP, a polarity control signal POL and a source output enable signal SOE, etc. The gate driving control signal GDC includes a gate start pulse GSP and a gate output enable signal GOE, etc.

The data driver 430 continuously drives the odd-numbered dynamic image frame and the even-numbered dynamic image frame having gray level values multiplied and converted by the frame processor 410 within a certain time with respect to the liquid crystal display panel 110 or continuously drives the odd-numbered still image frame and the even-numbered still image frame multiplied by the frame processor 410 within a certain time with respect to the liquid crystal display panel 110 in response to the frame driving control signal FCS from the timing controller 420.

The gate driver 440 sequentially generates a scanning pulse in response to the gate driving control signal GDC and the gate shift clock GSC from the timing controller 420 to apply them to the gate lines GL1 to GLn. Particularly, the gate driver 440 sequentially applies the scanning pulse to the gate lines GL1 to GLn when the odd-numbered frame, of the odd-numbered frame and the even-numbered frame having frame frequencies multiplied by the frame processor 410, is being driven, and thereafter sequentially applies the scanning pulse to the gate lines GL1 to GLn again when the even-numbered frame is being driven.

Figure 28:
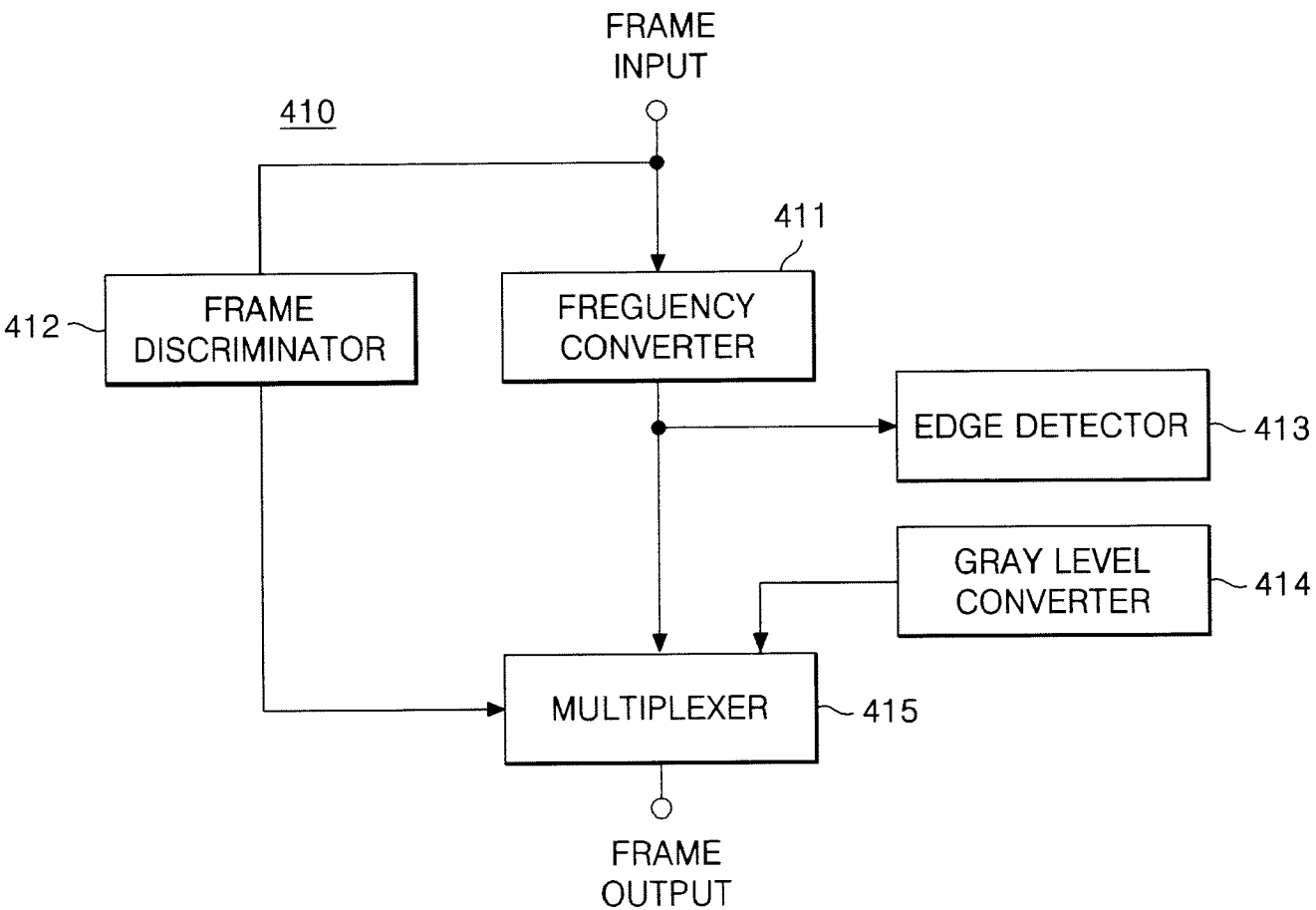
FIG. 28 is a block diagram of the frame processor shown in FIG. 27.

FIG. 28 illustrates a configuration of the frame processor 410 in FIG. 27.

Referring to FIG. 28, the frame processor 410 includes a frequency converter 411 for multiplying a frame frequency of an inputted current frame to continuously output the multiplied odd-numbered frame and the multiplied even-numbered frame within a certain time, a frame discriminator 412 for determining whether the current frame is a still image frame or a dynamic image frame to selectively generate the first or second selection signal in accordance with the determined result, an edge detector 413 for detecting an edge area at which a motion blur occurs from the multiplied odd-numbered frame and the multiplied even-numbered frame, a gray level converter 414 for converting gray levels of pixels positioned at the detected edge area, of pixels at the multiplied odd-numbered frame, into high gray levels and, at the same time, converting gray levels of pixels positioned at the detected edge area, of pixels at the multiplied even-numbered frame, into low gray levels, and a multiplexer 415 for continuously outputting the odd-numbered still image frame and the even-numbered still image frame multiplied by the frequency converter 411 in response to the first selection signal, or continuously outputting the odd-numbered dynamic image frame and the even-numbered dynamic image frame having gray level values converted by the gray level converter 414 in response to the second selection signal.

The frequency converter 411 may have the same configuration and function as the frequency converter 211 shown in FIG. 4.

The frame discriminator 412 may have the same configuration and function as the frame discriminator 212 shown in FIG. 4.

The edge detector 413 may have the same configuration and function as the edge detector 312 shown in FIG. 15.

The gray level converter 414 may have the same configuration and function as the gray level converter 313 shown in FIG. 15.

The multiplexer 415 outputs the odd-numbered still image frame and the even-numbered still image frame inputted continuously from the frequency converter 411 to the timing controller 420 in response to a first selection signal '0' when the first selection signal '0' for indicating an output of the still image from the frame discriminator 412 is inputted to the selection terminal thereof. On the other hand, the multiplexer 415 outputs the odd-numbered dynamic image frame and the even-numbered dynamic image frame, at which gray level values at the edge area detected by the gray level converter 414 are converted, to the timing controller 420 in response to a second selection signal '1' when the second selection signal '1' for indicating an output of the dynamic image from the frame discriminator 412 is inputted to the selection terminal thereof.

As described above, according to the present invention, the liquid crystal display device multiplying a frame frequency continuously drives the same dynamic image frames having the converted gray level values within a certain time while continuously driving the same still image frames having the non-converted gray level values within a certain time, so that it becomes possible to minimize a flicker from being generated from the still image frame due to the multiplication of frame frequency and hence improve a motion blur.

Furthermore, according to the present invention, the liquid crystal display device multiplying a frame frequency converts only gray level values of pixels positioned at an edge area where a motion blur occurs, so that it becomes possible to reduce a brightness difference of the entire field caused by a gray level data insertion and hence reduce a motion blur caused by the brightness difference as well as a flicker.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

frame processing means for multiplying a frame frequency of an inputted current frame to generate a multiplied odd-numbered frame and a multiplied even-numbered frame, and for outputting a multiplied odd-numbered still image frame and a multiplied even-numbered still image frame without any conversion of gray level values when the current frame is a still image frame while outputting a multiplied odd-numbered dynamic image frame and a multiplied even-numbered dynamic image frame with converted gray level values when the current frame is a dynamic image frame;

timing controlling means for controlling a driving timing of the odd-numbered still image frame and the even-numbered still image frame multiplied by said frame processing means or controlling a driving timing of the odd-numbered dynamic image frame and the even-numbered dynamic image frame having gray level values multiplied and converted by said frame processing means; and data driving means for substantially continuously driving the odd-numbered still image frame and the even-numbered still image frame multiplied by said frame processing means within a certain time with respect to a liquid crystal display panel or substantially continuously driving the odd-numbered dynamic image frame and the even-numbered dynamic image frame having gray level values multiplied and converted by said frame processing means within a certain time with respect to the liquid crystal display panel under control of said timing control means.

2. The liquid crystal display device as claimed in claim 1, wherein the frame processing means includes:

a frequency converter for multiplying said frame frequency of the inputted current frame to substantially continuously output the multiplied odd-numbered frame and the multiplied even-numbered frame;

a frame discriminator for determining whether the current frame is a still image frame or a dynamic image frame to generate a first selection signal or a second selection signal in accordance with the determined result;

a gray level converter for converting gray level values of pixels at the multiplied odd-numbered frame and the multiplied even-numbered frame; and a multiplexer for substantially continuously outputting the multiplied odd-numbered still image frame and the multiplied even-numbered still image frame in response to said first selection signal or substantially continuously outputting the odd-numbered dynamic image frame and the even-numbered dynamic image frame having gray levels converted by the gray level converter in response to said second selection signal.

3. The liquid crystal display device as claimed in claim 2, wherein the frequency converter includes:

a storage unit for temporarily storing said inputted current frame; and a frequency conversion controller for temporarily storing said inputted current frame into the storage unit, and for continuously reading out and outputting the frame at the storage unit within a certain time such that said first frame frequency is multiplied into the second frame frequency.

4. The liquid crystal display device as claimed in claim 3, wherein said first frame frequency is approximately 60 Hz and said second frame frequency is approximately 120 Hz.

5. The liquid crystal display device as claimed in claim 2, wherein the frame discriminator includes:

a storage unit for storing at least one previous frame of said inputted current frame;

a frame discrimination controller for storing said previous frame to the storage unit and for reading out said previous frame in response to an input of the current frame to control a discrimination of an image state of the current frame;

a gray level difference value calculator for calculating gray level difference values between corresponding pixels at the previous frame and the current frame;

an adder for adding the calculated gray level difference values under; and a selection signal generator for comparing a sum added by the adder with a predetermined reference gray level value to generate said first selection signal indicating an output of the still image frame or said second selection signal indicating an output of the dynamic image frame in accordance with the compared result and output it to said multiplexer.

6. The liquid crystal display device as claimed in claim 5, wherein the selection signal generator determines the current frame to be a still image frame when said sum is smaller than the predetermined reference gray level value to generate said first selection signal and output it to said multiplexer.

7. The liquid crystal display device as claimed in claim 5, wherein the selection signal generator determines the current frame to be a dynamic image frame when said sum is larger than the predetermined reference gray level value to generate said second selection signal and output it to said multiplexer.

8. The liquid crystal display device as claimed in claim 7, wherein the gray level difference value calculator calculates gray level difference values between the corresponding pixels at the current frame and at a single of previous frame.

9. The liquid crystal display device as claimed in claim 7, wherein the gray level difference value calculator calculates gray level difference values between the corresponding pixels at the current frame and at least two previous frames.

10. The liquid crystal display device as claimed in claim 2, wherein the gray level converter includes:

a gray level detector for detecting gray level values of pixels at the odd-numbered frame and the even-numbered frame multiplied by the frequency converter;

a gray level calculator for calculating a low gray level conversion value and a high gray level conversion value intended to be converted with the aid of the gray level value detected by the gray level detector and the predetermined reference gray level value; and a gray level converting unit for converting gray levels of pixels at the odd-numbered frame and the even-numbered frame, of the same frames multiplied by the frequency converter, into said calculated low gray level conversion value and said calculated high gray level conversion value, respectively.

11. The liquid crystal display device as claimed in claim 10, wherein the gray level calculator subtracts the predetermined reference gray level value from said detected gray level value to calculate said low gray level conversion value and, at the same time, adds the predetermined reference gray level value to said detected gray level value to calculate said high gray level conversion value.

12. The liquid crystal display device as claimed in claim 10, wherein the gray level converter converts gray levels of pixels at the odd-numbered and even-numbered frames such that brightness values of pixels at the current frame are kept equally.

13. A liquid crystal display device, comprising:

frequency converting means for multiplying a frame frequency of an inputted current frame to continuously output a multiplied odd-numbered frame and a multiplied even-numbered frame;

frame discriminating means for determining whether the current frame is a still image frame or a dynamic image frame to generate a first selection signal or a second selection signal in accordance with the determined result;

gray level converting means for converting gray level values of pixels at the multiplied odd-numbered frame and the multiplied even-numbered frame; and selecting means for substantially continuously outputting the multiplied odd-numbered still image frame and the multiplied even-numbered still image frame in response to said first selection signal or substantially continuously outputting the odd-numbered dynamic image frame and the multiplied even-numbered dynamic image frame having gray levels converted by the gray level converting means in response to said second selection signal.

14. The liquid crystal display device as claimed in claim 13, wherein the frequency converting means includes:

a storage unit for temporarily storing said inputted current frame; and a frequency conversion controller for temporarily storing said inputted current frame into the storage unit, and for substantially continuously reading out and outputting the frame at the storage unit within a certain time such that said first frame frequency is multiplied into the second frame frequency.

15. The liquid crystal display device as claimed in claim 14, wherein said first frame frequency is approximately 60 Hz and said second frame frequency is approximately 120Hz.

16. The liquid crystal display device as claimed in claim 13, wherein the frame discriminating means includes:

a storage unit for storing at least one previous frame of said inputted current frame;

a frame discrimination controller for storing said previous frame to the storage unit and for reading out said previous frame in response to an input of the current frame to control discrimination of an image state of the current frame;

a gray level difference value calculator for calculating gray level difference values between the corresponding pixels at the previous frame and the current frame under control of said frame discrimination controller;

an adder for adding the calculated gray level difference values under control of said frame discrimination controller; and a selection signal generator for comparing a sum added by the adder with a predetermined reference gray level value to generate said first selection signal indicating an output of the still image frame or said second selection signal indicating an output of the dynamic image frame in accordance with the compared result under control of said frame discrimination controller.

17. The liquid crystal display device as claimed in claim 16, wherein the selection signal generator determines the current frame to be a still image frame when said sum is smaller than the predetermined reference gray level value to generate said first selection signal and output it to the selecting means.

18. The liquid crystal display device as claimed in claim 16, wherein the selection signal generator determines the current frame to be a dynamic image frame when said sum is larger than the predetermined reference gray level value to generate said second selection signal and output it to the selecting means.

19. The liquid crystal display device as claimed in claim 16, wherein the gray level difference value calculator calculates gray level difference values between the corresponding pixels at the current frame and at a single of previous frame.

20. The liquid crystal display device as claimed in claim 16, wherein the gray level difference value calculator calculates gray level difference values between the corresponding pixels at the current frame and at least two previous frames.

21. The liquid crystal display device as claimed in claim 13, wherein the gray level converting means includes:

a gray level detector for detecting gray level values of pixels at the odd-numbered frame and the even-numbered frame multiplied by the frequency converting means;

a gray level calculator for calculating a low gray level conversion value and a high gray level conversion value intended to be converted with the aid of the gray level value detected by the gray level detector and the predetermined reference gray level value; and a gray level converter for converting gray levels of pixels at the odd-numbered frame and the even-numbered frame, of the same frames multiplied by the frequency converting means, into said calculated low gray level conversion value and said calculated high gray level conversion value, respectively.

22. The liquid crystal display device as claimed in claim 21, wherein the gray level calculator subtracts the predetermined reference gray level value from said detected gray level value to calculate said low gray level conversion value and, at the same time, adds the predetermined reference gray level value to said detected gray level value to calculate said high gray level conversion value.

23. The liquid crystal display device as claimed in claim 21, wherein the gray level converting means converts gray levels of pixels at the odd-numbered and even-numbered frames such that brightness values of pixels at the current frame are kept equally.

24. The liquid crystal display device as claimed in claim 13, wherein the selecting means includes:

a multiplexer having a selection terminal connected to the output terminal of the frame discriminating means, input terminals connected to the output terminal of the frequency converting means and to the output terminal of the gray level converting means, and an output terminal connected to said frame output terminal.

25. A method of driving a liquid crystal display device, comprising:

(A) if a current frame is inputted in such a state that a previous frame has been stored, multiplying a first frame frequency into a second frame frequency to generate the same still image frames or the same dynamic image frames driven substantially continuously within a certain time;

(B) converting gray level values of pixels at the generated frames to be driven with said second frame frequency;

(C) determining whether the current frame is a still image frame or a dynamic image frame with the aid of said previous frame to generate a first selection signal or a second selection signal in accordance with the determined result; and (D) substantially continuously outputting the generated still image frames in response to said first selection signal and substantially continuously outputting the dynamic image frames having the converted gray levels in response to said second selection signal.

26. The method as claimed in claim 25, wherein said step (A) includes:

if said current frame is inputted, temporarily storing said current frame; and substantially continuously reading out said stored current frame twice within a certain time to generate the same still image frames or the same dynamic image frames driven substantially continuously within a certain time, in order to multiply said first frame frequency into said second frame frequency.

27. The method as claimed in claim 26, wherein said first frame frequency is approximately 60Hz and said second frame frequency is approximately 120 Hz.

28. The method as claimed in claim 25, wherein said step (B) includes:

detecting gray level values of pixels at the generated same frames;

subtracting a predetermined reference gray level value from the detected gray level value to calculate a low gray level conversion value intended to be converted and, at the same time, adding said predetermined reference gray level value to the detected gray level value to calculate a high gray level conversion value intended to be converted; and converting gray levels of pixels at the odd-numbered frame, of the generated same frames, into said calculated low gray level conversion values and converting gray levels of pixels at the even-numbered frame into said calculated high gray level conversion values.

29. The method as claimed in claim 25, wherein said step (C) includes:

if the current frame is inputted, reading out said stored previous frame;

calculating gray level difference values between the corresponding pixels of the read previous frame and the current frame;

adding all the calculated gray level difference values to obtain a sum;

comparing said sum with the predetermined reference gray level value to determine whether or not said sum is smaller than the predetermined reference gray level value;

if said sum is smaller than the predetermined reference gray level value, determining the current frame to be a still image frame, thereby generating said first selection signal; and if said sum is larger than the predetermined reference gray level value, determining the current frame to be a dynamic image frame, thereby generating said second selection signal.

* * * * *